US006102612A

United States Patent [19]

Pricone et al.

[11] Patent Number: 6,102,612

[45] Date of Patent: Aug. 15, 2000

[54] CONTROLLED TIRE IMPACT PAVEMENT MARKER

[75] Inventors: Robert M. Pricone, Libertyville; Anthony J. Montalbano, Barrington, both of Ill.; Liviu A. Coman, Nutley, N.J.; Michael E. Flader, Chicago, Ill.; Loren M. Lundtveit, Waukegan, Ill.; Edward V. Nick, Fox River Grove, Ill.; Sidney A. Heenan, deceased, late of Park Ridge; by Ronald A. Sandler, executor, Chicago, both of Ill.; Jeffrey Tidaback, Arlington Heights, Ill.

[73] Assignee: Stimsonite Corporation, Niles, Ill.

[21] Appl. No.: 09/098,226

[22] Filed: Jun. 16, 1998

[51] Int. Cl.[7] ..... E01F 9/06; E01F 9/08; E01F 9/00

[52] U.S. Cl. ..... 404/13; 404/9; 404/12

[58] Field of Search ..... 404/9, 12, 13, 404/14

[56] References Cited

U.S. PATENT DOCUMENTS

| | | | |
|---|---|---|---|
| 3,332,327 | 7/1967 | Heenan . | |
| 3,409,344 | 11/1968 | Balint et al. . | |
| 3,485,148 | 12/1969 | Heenan . | |
| 3,587,416 | 6/1971 | Flanagan . | |
| 3,790,293 | 2/1974 | Heenan et al. . | |
| 3,809,487 | 5/1974 | Flanagan . | |
| 4,195,945 | 4/1980 | Heenan . | |
| 4,208,090 | 6/1980 | Heenan . | |
| 4,227,772 | 10/1980 | Heenan . | |
| 4,232,979 | 11/1980 | Johnson, Jr. et al. . | |
| 4,340,319 | 7/1982 | Johnson, Jr. et al. . | |
| 4,428,320 | 1/1984 | Opit et al. . | |
| 4,498,733 | 2/1985 | Flanagan . | |
| 4,596,622 | 6/1986 | Heenan et al. . | |
| 4,753,548 | 6/1988 | Forrer . | |
| 4,797,024 | 1/1989 | Forrer . | |
| 4,875,798 | 10/1989 | May . | |
| 4,883,384 | 11/1989 | Hedgewick | 404/14 |
| 5,074,706 | 12/1991 | Paulos | 404/12 |
| 5,098,217 | 3/1992 | Hedgewick et al. . | |
| 5,104,256 | 4/1992 | D'Avela . | |
| 5,226,745 | 7/1993 | Gartlacher | 404/14 |
| 5,277,513 | 1/1994 | Flanagan et al. . | |
| 5,302,048 | 4/1994 | Paulos et al. . | |
| 5,308,186 | 5/1994 | Hedgewick | 404/14 |
| 5,327,850 | 7/1994 | Sly et al. . | |
| 5,354,143 | 10/1994 | Lindner | 404/9 |
| 5,392,728 | 2/1995 | Speer et al. . | |
| 5,412,381 | 5/1995 | Dicks . | |
| 5,454,664 | 10/1995 | Siblik . | |
| 5,816,737 | 10/1998 | Siblik | 404/13 |
| 5,857,802 | 1/1999 | Richter | 404/14 |

FOREIGN PATENT DOCUMENTS 2190123A 11/1987 United Kingdom .

OTHER PUBLICATIONS

Stimsonite product brochure entitled "Model 88™ Reflective Pavement Marker", 1993.

Stimsonite product brochure entitled "Model 953™ Glass-Faced Reflective Pavement Marker", 1994.

Stimsonite product brochure entitled "Model 911™ Glass-Faced Reflective Pavement Marker", 1993.

*Primary Examiner*—Eileen Dunn Lillis
*Assistant Examiner*—Gary S. Hartmann
*Attorney, Agent, or Firm*—Jones, Day, Reavis & Pogue

[57] ABSTRACT

A pavement marker comprising a base member and a signal device for sending a light signal to a driver of an oncoming vehicle further includes a longitudinally extending tire directing hood member that directs tire contact away from the upper edge, upper portion, and upper generally corner portions of the signal device front face, while allowing tire contact with the lower portion of the signal device front face. The signal device front face is at a predetermined recess depth in said pavement marker, and is at a predetermined angle with respect to the roadway surface. The marker can be either a snowplowable marker or a sun country marker. The signal device optionally can be mounted on a base member by a mechanical interlock. Optional drainage channels can be provided in the base member to allow drainage of fluid from in front of the lower portion of the signal device.

55 Claims, 18 Drawing Sheets

CONTROLLED TIRE IMPACT PAVEMENT MARKER

This invention relates to an improved pavement marker having light-transmitting signal means, and more particularly to such a pavement marker designed to control the impact of tires of oncoming vehicles against the front face of such signal means and to direct the action of such oncoming tires on said signal means. For purposes of this application, "signal means" is intended to include retroreflectors, whether of the cube corner or glass bead type; signal devices, such as LED types as disclosed in U.S. Pat. No. 5,412,381, or other illuminated flashing roadway markers which may include retroreflectors as part of the lens element.

Pavement markers are used to provide visual guidance on the surface of a roadway. Typically, pavement markers comprise a base member designed to be firmly secured to the associated roadway surface; and a retroreflective signal means mounted on or formed as part of the base member so as to retroreflect light from the headlights of an oncoming vehicle back to the vehicle's driver, thereby delineating the highway. Pavement markers are specifically designed to be either "snow country" markers, in which case the base member usually is a metal member designed to be fitted in a specially cut recess in the pavement and which is able to withstand the impact of oncoming snowplow blades (such as in U.S. Pat. No. 4,195,945), or "sun country" markers (the basic U.S. Pat. No. 3,332,327), both of which patents are incorporated herein by reference in their entirety. In sun country markers, the base member is typically a molded plastic housing having cube corner elements forming the retroreflective signal means, the housing underside being filled with epoxy; the epoxy-filled housing is adhered to the roadway surface, such as by means of a bituminous adhesive, epoxy or other suitable adhesive. Numerous other versions of retroreflectors exist, for example, retroreflective cube corner elements formed of a synthetic resin such as methyl methacrylate, suitable structures being disclosed commonly assigned in U.S. Pat. Nos. 3,485,148 and 4,208,090, both of which are incorporated herein by reference in their entirety. Others have tried to use retroreflective sheeting behind a lens, but these markers have not been durable enough.

Both sun country and snow country markers must be able to withstand the repeated impacts from tires of oncoming vehicles. The reflective signal means of the pavement markers are subject to wiping action by tires, which can be helpful in removing accumulated dirt and grime which otherwise would decrease the reflectivity of the marker. The efficacy of tire-wiping is determined in part by the angle at which the signal means is mounted on the base member with respect to the roadway surface. Tire-wiping can also result in deleterious abrasion of the reflective surface of the signal means, which can decrease the overall reflectivity of the pavement marker. The above-referenced U.S. Pat. No. 3,332,327 discloses a preferred range of angles of the signal means to the roadway surface to achieve adequate wiping while limiting abrasion.

Another important source of abrasion of light-transmitting surfaces of pavement marker signal means is the "sandblasting" effect that occurs when the air currents of passing tires blow sand, grit, or other abrasive matter against the surface. This type of abrasion is especially problematic on high speed roadways, and on roadways where sand or other abrasive materials are applied to the roadway surface to provide improved traction. "Sandblast" abrasion can occur even if there is no direct contact between a signal means and a passing vehicle tire.

Attempts to minimize abrasion of the front face of a pavement marker signal means have involved providing protective surfaces directly on the front face of the signal means. U.S. Pat. Nos. 4,232,979, 4,340,319, 4,596,622, all assigned to the common assignee and incorporated herein by reference in their entirety, disclose the commercially most effective device, an abrasion-resistant glass sheet fixedly disposed on the front surface of the signal means. U.S. Pat. No. 4,753,548 relates to a photopolymerizable composition as an abrasion-resistant coating for a pavement marker signal means front surface. In use, those coatings have not been as effective as the glassed surface.

Some prior art pavement markers have been designed to attempt to prevent or minimize the contact of oncoming tires with all or a portion of the surface of the signal means. The aforementioned U.S. Pat. Nos. 4,340,319 and 4,753,548 each disclose a protective bead along at least the upper edge of the signal means front surface so that oncoming tires will not abrade against the top edge of the glass sheet or acrylic coating, respectively.

U.S. Pat. No. 5,104,256 discloses a canopy and a vertically oriented reflector to avoid all tire abrasion and wiping.

U.S. Pat. No. 5,302,048, in FIGS. 9–10 discloses a lens holder for a detachable lens assembly mountable on the piston of a resilient depressible pavement marker, such that the lens assembly is depressed below the road surface in response to surface traffic to withstand impact, and having a domed surface to deflect the downwardly directed force without damaging the marker.

U.S. Pat. No. 5,392,728 assigned to the Davidson Plastics Company, discloses a pavement marker wherein the signal means is concave and is disposed within a concave surface of the base member, the radius of curvature of the concavity being such that the tire purportedly does not contact any part of the reflective surface as it passes over the pavement marker.

U.S. Pat. No. 5,277,513, incorporated herein by reference, suggests at column 12, lines 14–17 a snowplowable marker having a lens mounted in a housing wherein the housing has a longitudinally extending brow that provides some of the housing material to protect the lens assembly from impact and tire abrasion forces.

U.S. Pat. No. 5,454,664 discloses a snow country pavement marker having a protective "canopy" that extends over the upper edge of the signal means (but not over the lens area), and having an inner distance between the side rails of the base member deliberately narrower than the width of a tire, such that the side rails and canopy together purport to prevent a tire from contacting the reflective surface of the signal means. In commercial embodiments of that patent, however, sold under the name "IronStar" by Hallen Products, Inc., it appears that the inner distance between the side rails is large enough to allow a tire to contact the signal means.

U.K. Patent Application GB 2,190,123A discloses a pavement marker wherein the signal means is disposed within a recess in the pavement marker base member, the recess being of sufficient depth such that a tire will not contact any part of the signal means front surface.

Standard reflective signal means as used in the pavement marker art are subject to breakage over time. Typically, breakage is initiated not only at the upper edge of the signal means, where prior art markers have sought to provide protection, but all through the upper portion of the signal means, which can include about the upper one-fourth to two-thirds of the signal means reflective face. Breakage in the upper portion of the signal means propagates downwardly, ultimately rendering the entire signal means essentially useless.

Ongoing studies by applicant's assignee indicate that the extent of damage a signal means front surface experiences from tire impact will be determined at least in part by the transverse position of an oncoming vehicle tire with respect to the center of the signal means front surface. The impact of an oncoming tire that is centered with respect to the signal means will cause less damage than an off-center impact, presumably because the force of the impact is spread over a larger area. Most impacts from oncoming vehicle tires, however, are off-center. The upper generally corner portions of the signal means front face have been found to be particularly vulnerable to damage from off-center impacts, presumably because the force of the impact is concentrated in a relatively small area of the signal means. Further, when the tire impact is off-center, the tire tends to bulge toward the center of the signal means, yet because of the stiffness of the tire material, the tire may not conform to the portion of the signal means it impacts asymmetrically. These forces can create additional asymmetric stresses at the upper generally corner portions of the signal means front face.

Prior studies, such as reported by Davidson in the aforementioned U.S. Pat. No. 5,392,728 do not appear to deal either with this issue, or with tires of different diameters and inflation pressures, such as are used on trucks, cars, motorcycles, and a wide variety of types and sizes of vehicles as are found on modern roadways.

Signal means which are broken or damaged by abrasion as described above must be replaced. Usually the base member adhered to the roadway and in which the signal means is mounted will not be damaged and need not be replaced. This is particularly so in the case of snowplowable markers, for which the useful life of the base member can equal that of the roadway surface in which it is installed. Thus, the damaged signal means much be removed from the base member, and a new signal means installed therein. If the signal means is mounted to the base member by means of an adhesive, removal of the damaged signal means can be difficult, laborious, time-consuming, and expensive. It would be desirable to have both a snowplowable pavement marker and a sun country marker which control the impact from oncoming tires on the signal means, yet in which the signal means is readily removed from and reinstalled on the pavement marker base member, while being retained securely therein during operation in traffic.

Existing pavement markers tend to accumulate dirt and grime in the lower portion of the front face of the signal means. Snowplowable markers also tend to accumulate water or snow in the area of the base member just forward of the signal means front face. This accumulated fluid can diminish the reflectivity of the signal means. It would be desirable to have means integral with the construction of a snowplowable pavement marker to facilitate removal of this accumulated fluid from the front face of the signal means.

It is thus one object of the invention to provide a pavement marker having a means to direct tire contact away from the upper edge, upper portion, and upper generally corner portions of the signal means front face, while still allowing some tire contact along the lower portion of the signal means front face where more dirt apparently tends to accumulate.

It is yet another object of the invention to provide a snowplowable pavement marker having a means to direct tire contact away from the upper edge, upper portion, and upper generally corner portions of the signal means front face, while still allowing some tire contact along the lower portion of the signal means front face.

It is yet another object of the invention to provide a sun country pavement marker having a means to direct tire contact away from the upper edge, upper portion, and upper generally corner portions of the signal means front face, while still allowing some tire contact along the lower portion of the signal means front face.

It is still another object of the invention to provide a pavement marker having a base member and a signal means wherein a signal means can be readily removed from and reinstalled on the base member, while being retained securely therein during operation in traffic.

It is still another object of the invention to provide a pavement marker having integral means for facilitating removal of accumulated fluid from the signal means front face.

Additional objects, advantages, and novel features of the instant invention will be more fully understood in conjunction with the following description of the invention and the accompanying drawings.

SUMMARY OF THE INVENTION

In accordance with the invention, a pavement marker is provided having a base member adapted to be fixedly attached to a roadway surface, a signal means, a support means for supporting the signal means on said base member, and a means for controlling the impact of an oncoming vehicle tire to direct the tire contact away from the upper edge, upper portion, and upper generally corner portions of the signal means front face, while allowing some tire contact at the lower portion. The impact-control means comprises a protective tire-directing hood member disposed at least partially above said signal means and extending longitudinally forward of the upper edge of the front surface of said signal means, the protective tire-directing hood member cooperating with the structure of the base member to control the impact of tires of oncoming vehicles against said pavement markers and the signal means mounted thereon so as to minimize tire contact against the upper edge, upper portion and upper generally corner portions of the signal means, while allowing contact of the oncoming vehicle tire at the lower portion of the signal means front face where dirt and grime tend to accumulate, so that effective tire wiping of the lower portion of the signal means can occur.

The signal means of the instant invention can be a retroreflector such as is known in the art of pavement markers. The retroreflector can be of the cube-corner type, either macrocubes or microcubes, or the retroreflector can comprise retroreflective beads. If either microcubes or beads are used, the retroreflector can be a strip of retroreflective sheeting. Other light-emitting signal means can be used, (with or without retroreflectors) including light-emitting diodes (LEDs), and flashing roadway markers. Regardless of the type used, the signal means will have a front face that will direct light toward the driver of an oncoming vehicle. The front surface of the signal means preferably is provided with an abrasion-resistant surface, such as glass or a polymerized coating, to guard against abrasion of the lower portion of the surface as may be caused by tire wiping, and to further guard against abrasion of the entire surface as may be caused by the "sandblasting" effect of airborne particulates carried on high-speed air currents from passing vehicles.

For a snow country marker, wherein protection of the light transmissive signal means from oncoming snowplow blades is provided by a base member having two laterally spaced apart inclined upper surfaces, each forming an inclined ramp extending longitudinally of said base member from adjacent to one end thereof toward the other end thereof and rising to an uppermost portion, and a support means disposed between the inclined surfaces adjacent to the uppermost ends thereof, the support means being adapted for carrying a signal means between and below the inclined ramps, the protective tire-directing hood member can be a portion of the base member which extends transversely between the uppermost ends of the inclined surfaces, and longitudinally over and beyond the upper edge of the signal means disposed on the support means, the protective tire-directing hood member cooperating with the ramps to further facilitate deflection of an oncoming angled snowplow blade from contact with said signal means, and the base member and protective tire-directing hood member being configured such that the signal means front face is at a predetermined recess depth (defined infra) to control the impact of tires of oncoming vehicles against the pavement markers so as to minimize the contact of the tires against the upper edge, upper portion, and upper generally corner portions of the signal means front face, while allowing some contact of the oncoming vehicle tires on the lower portion of the signal means where dirt and grime accumulate. Alternatively, the protective tire-directing hood member may be formed as part of a signal means assembly, the assembly then being mountable on the base member.

The snowplowable pavement marker preferably is provided with means intended to facilitate removal of fluid that accumulates in front of the signal means front face. These means can comprise channels formed in the inclined ramp surfaces of the base member on either side of the front face of the signal means so that pressure from a moving tire can flush out fluid and debris through the channels.

Snowplowable markers made in accordance with the instant invention can be either mono-directional, i.e., snowplowable in a single direction, or bi-directional, i.e., snowplowable in two longitudinally opposing directions.

For a sun country marker, the base member may comprise two separate members, a lower member intended to be adhered to the roadway surface and having a support means for carrying a signal means and having longitudinally extending protective surfaces along the sides of the support surface to protect the signal means from side impact of tires, and an upper member which fits over said lower member in mating relationship, the upper member including the protective tire-directing hood member that extends longitudinally over and beyond the upper edge of the signal means, the hood member and the lower member being configured such that the signal means front face is at a predetermined recess depth (defined infra) to control the impact of tires of oncoming vehicles so as to minimize tire contact against the upper edge, upper portion, and upper generally corner portions of the signal means, while allowing contact of the oncoming vehicle tires at the lower portion of the signal means where dirt and grime tend to accumulate.

For sun country markers having an upper portion, a lower portion, and a signal means, the upper and lower portions may both be made of a high-impact plastic; the plastic materials used in the upper and lower portions can be the same, or the material of the upper portion can be a tougher, more-impact resistant plastic than the lower portion. Means for securing the upper portion to the lower portion will be determined in part by the materials from which the portions are made.

In yet another embodiment of a sun country marker, the base member can be a single extruded piece of either metal or high-impact plastic with the protective tire-directing hood member formed integrally therein, wherein the support means comprises one or more recesses for supporting the signal means at a desired angle with respect to the roadway surface. Such a base member can be similar in many respects to the signal means assembly used in certain embodiments of a snowplowable pavement marker of the instant invention.

For both snowplowable and sun country markers of the instant invention, the useful life of the base member can be substantially longer than the useful life of the signal means. To facilitate replacement of a broken or damaged signal means on a base member, the base member and signal means or signal means assembly are provided with first and second interlock means, respectively, the first and second interlock means cooperating to provide an interlock fit to resist separation of the signal means or signal means assembly from the base member by applied shear forces experienced in traffic conditions, while facilitating removal and installation of the signal means or signal means assembly from the base member. The first and second interlock means may comprise, for example, one or more projections and corresponding recesses which fit together in frictional engagement. In an alternative embodiment, the first and second interlock means can comprise respective pluralities of projecting structures, the pluralities being engageable with each other to resist separation of the signal means or signal means assembly from the base member by applied shear forces. For a snowplowable marker in which the base member is a metal casting, the first interlock means can be a separate component which fits into a receiving means of the base member.

DESCRIPTION OF THE PREFERRED EMBODIMENTS

The instant invention will be described first with reference to snowplowable pavement markers, and then with reference to sun country pavement markers.

Snowplowable Pavement Markers

Figure 1:
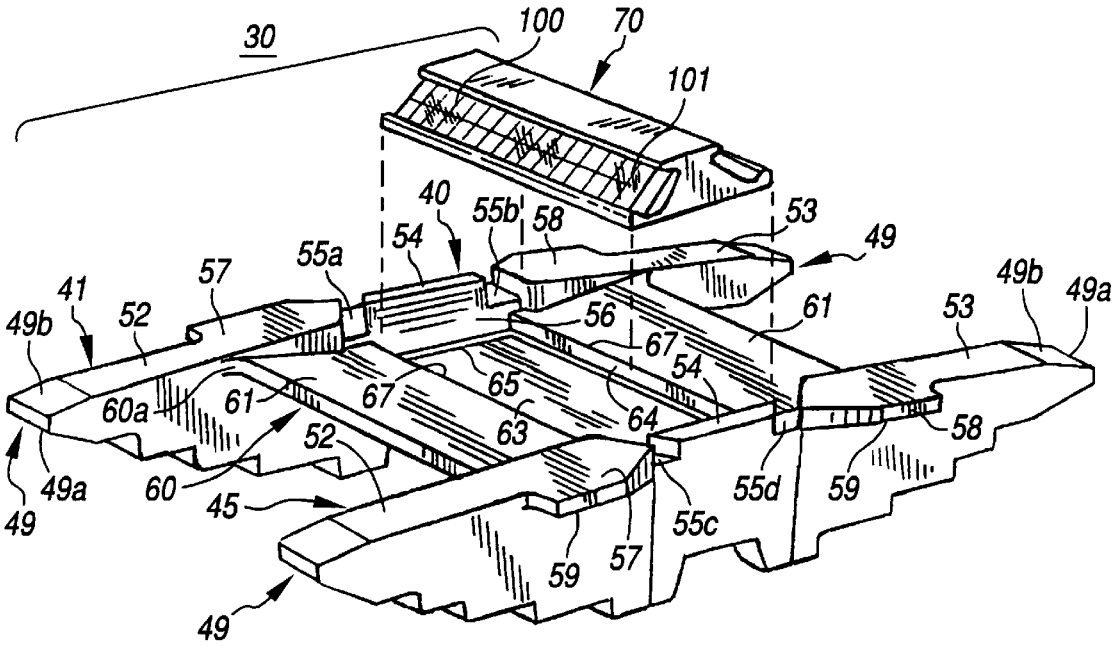
FIG. 1 is an exploded front perspective view of one version of a bi-directional snowplowable pavement marker, including a base member and one form of signal means assembly, the marker embodying a protective tire-directing hood member of the instant invention for controlling tire impact on the signal means.
Figure 2:
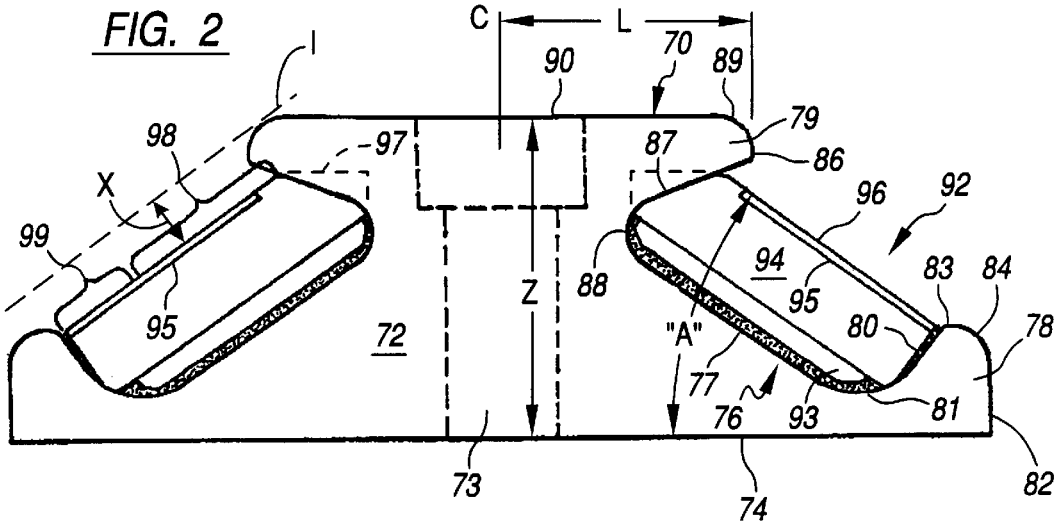
FIG. 2 is an enlarged side elevation view of the signal means assembly of FIG. 1.
Figure 3:
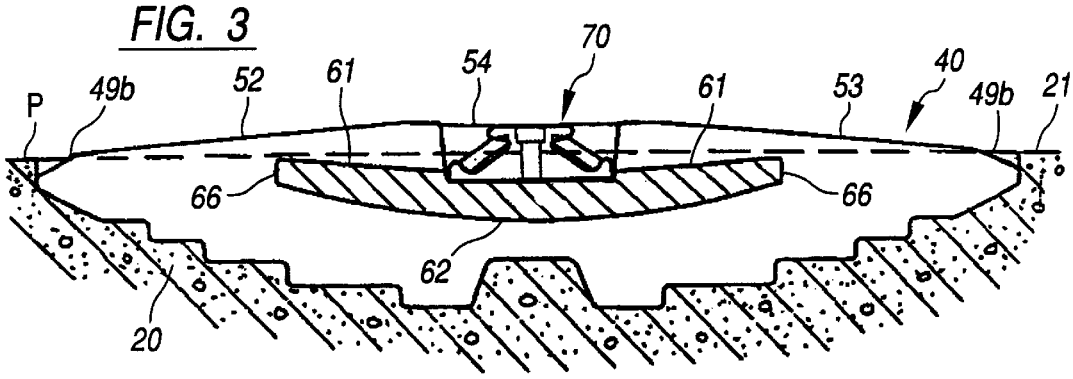
FIG. 3 is a cross-sectional side view of the snowplowable pavement marker of FIG. 1 installed in a roadway.

Referring now to snowplowable markers, FIGS. 1 through 3 illustrate a first embodiment of a snowplowable pavement marker, generally designated by the numeral 30. The general overall structure of this first embodiment is similar to that illustrated and described in U.S. Pat. No. 5,277,513, incorporated herein by reference in its entirety. Pavement marker 30 comprises a base member 40 and a signal means assembly 70. Base member 40 is adapted to be fixedly embedded in the pavement 20 of a roadway (see FIG. 3) so as to project above the pavement surface 21 and such that signal means assembly 70 is visible from oncoming vehicles traveling along the roadway, while being protected from oncoming snowplow blades inclined at an angle with respect to the transverse axis of the base member and perpendicular to the longitudinal direction of travel. The embodiment of the pavement marker 30 illustrated in FIG. 1 is bidirectionally plowable, although monodirectional embodiments of the instant invention are possible as discussed below. Base member 40 can be formed of a relatively high-strength material, such as pearlitic ductile iron, grade D5506, SAE J434 with a cast hardness of 179–255 Brinell.

Figure 1A:
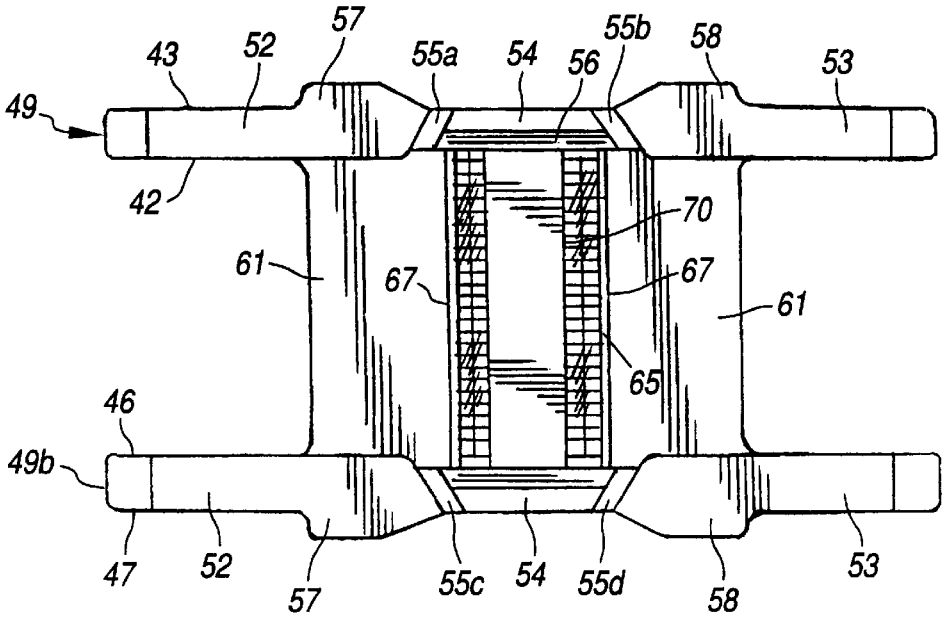
FIG. 1A is a top plan view of the pavement marker of FIG. 1.

The base member 40 preferably is cast as an integral unit, and includes a pair of parallel, elongated, laterally spaced apart keel members 41 and 45, the keel member 41 having parallel substantially vertically extending inner and outer side surfaces 42 and 43, and the keel member 45 having parallel substantially vertically extending inner and outer side surfaces 46 and 47, see FIG. 1A. The inside surfaces 42 and 46 are spaced apart about 3.54 inches, or wide enough to allow an oncoming vehicle tire to partially enter therebetween while allowing a snowplow blade to be placed at an angle up to about 50° with respect to a line perpendicular to the direction of travel without engaging the signal means, when the snowplow blade straddles both ramps as described hereinbelow.

Each of the keel members 41 and 45 is provided with a principal pair of inclined ramp surfaces 52 and 53 which respectively generally rise from the opposite ends of the keel member to uppermost portions which join a substantially flat top surface 54 and interconnect the side surfaces 42, 43 and 46, 47 at radiused corners to prevent stress concentrations where the base member 40 may be struck by a plow blade. The lower ends of the ramps 52 and 53 respectively join short inclined surfaces 49*b* which slope downwardly from the inclined surfaces 52 and 53 toward the adjacent ends 49 of the base member 40. The inclined surfaces 49*b* are respectively connected to the end portions 49 at short vertical end surfaces 49*a*.

The base member 40 has a plane P (see FIG. 3) which, in use, is intended to be coplanar with the plane of the associated pavement surface 21 and is substantially parallel to the top surfaces 54 and intersects the short inclined surfaces 49*b* about intermediate the length of such surfaces. The inclined surface 49*b* of the keel member 41 is coplanar with the inclined surface 49*b* of the keel member 45.

The purpose of the inclined surfaces 49*b* is to allow the short vertical end surface 49*a* of the ramps to be disposed below the pavement. The plowblade then will not strike the ends 49*a* and possibly cause the base member to be dislodged from the pavement.

The upper inner surfaces 42 and 46 of the ramps 52 and 53 of each keel 41 and 45 include inner recessed side wall portions 56 positioned centrally thereof. Flanges 57 and 58, respectively, extend longitudinally along and laterally outwardly from keel members 41 and 45. These flanges 57, 58 serve to engage the adjacent roadway while the keels reside in complementary cuts in the roadway surface. The flanges 57 and 58 each have bottom surfaces 59 that are coplanar and lie only slightly above the plane P, so as to accommodate some adhesive between bottom surfaces 59 and the associated roadway surface 21.

In accordance with one aspect of the instant invention, in each ramp member 52, 53 between flat top surface 54 and flanges 57, 58 there are disposed channels 55*a*, 55*b*, 55*c*, 55*d* intended to facilitate the drainage of accumulated fluid on said base member and in front of said signal means, as discussed more fully below.

The portions of the inner surfaces 42 and 46 of the keel members 41 and 45 extending from approximately midway between the ends of the ramps 52 and 53 are interconnected by a web-like support member, generally designated by the numeral 60. Support member 60 is substantially rectangular in plan outline and has radiused shoulders or flanges 60*a* formed at each of the four corners thereof for strength.

The support member 60 may have a pair of inclined recesses 61 in the top surface and an arcuate part-cylindrical convex bottom surface 62. The top and bottom surfaces 61 and 62, respectively, are connected at the opposite outer ends by short end surfaces 66 (FIG. 3). The inclined recesses 61 intersect the upper edge 67 of substantially vertical inner end walls 64, which extend downwardly from the inner ends of inclined recesses 61 at opposite longitudinally spaced ends of a central planar support means 63.

For support means using cube corner type retroreflectors, the support means 63 preferably is disposed slightly below the plane P and extends transversely across the support member 60 and between keels 41 and 45.

Longitudinally, the support means 63 extends substantially coextensively with the inner recessed side wall portions 56 of the keel members 41 and 45. The end walls 64 and the recessed inner side wall portions 56 of the keel members 41 and 45 are all connected to the support means 63 by a peripheral channel or groove 65 which extends around the support means 63 and is generally arcuate in transverse cross section.

In accordance with one embodiment of the invention, a signal means assembly 70 suitable for use with the aforedescribed pavement marker base member 40 comprises a housing member 72, shown in cross-section in FIG. 2, and a signal means 92. Housing member 72 may be formed of an extruded aluminum such as grade 6061 or may be formed of a tough plastic such as longfiber reinforced nylon. Housing member 72 has a substantially flat bottom surface 74 so sized and dimensioned as to fit on support means 63 within peripheral groove 65. Housing member 72 may be secured to support means 63 by means of suitable known and commercially available adhesives.

In accordance with other aspects of the invention, housing member 72 may be secured to support means 63 by a mechanical means, such as a bolt 73 indicated in dotted lines in FIG. 2, and extending through the center of housing member 72 and into a corresponding aligned recess in base member 40, not shown; or by mechanical interlock means as disclosed below in the embodiments of FIGS. 5–9.

Housing member 72 further comprises one or two signal means pockets 76, depending on whether the marker is monodirectional or bidirectional. Each signal means pocket 76 is defined by a relatively flat support surface 77, an upwardly extending lower lip 78, and a longitudinally extending protective tire-directing hood member 79; the flat support surface 77 being integrally formed with protective hood member 79 and lower lip 78. Flat support surface 77 may be disposed to support the signal means 92 at an angle A.

Lower lip 78 comprises inner wall 80 substantially perpendicular to support surface 77 with a concave radiused conjunction 81 therebetween. Lower lip 78 further comprises a substantially vertical front wall 82 which is integrally joined to upper wall 83 by convex radiused conjunction 84. Vertical front wall 82 of lower lip 78 is substantially the same size, shape, and orientation as the vertical inner end walls 64 of support means 63.

Longitudinally extending protective tire-directing hood member 79 includes a front tire-directing surface 86, integrally formed with upper wall 87 of pocket 76, which upper wall 87 is joined to support surface 77 at concave radiused conjunction 88. Housing member 72 further includes a top flat surface 90, substantially parallel to the bottom flat surface 74. Longitudinal protective tire-directing hood member 79 includes convex radiused conjunction 89 which joins top flat surface 90 and front tire-directing surface 86, and typically has a radius of curvature of about 0.060 inch.

As shown in FIG. 2, the distance L from housing member center axis C to the vertically projected end of tire-directing surface 86 is at least about 0.270 inches, and can be as long as about 0.431 inches. The vertical distance z between top flat surface 90 and bottom flat surface 74 is such that when housing member 72 is mounted on support means 63 of base member 40, top flat surface 90 is substantially coplanar with top surfaces 54 of keel members 41 and 45. Vertical distance z will depend on the construction of the associated pavement marker base member; for example for Stimsonite® 96 and Stimsonite® 96LP pavement marker base members, z can be on the order of about 0.56 inches, while for Stimsonite® 88 pavement marker base members, z can be on the order of about 0.72–0.82 inches.

An embodiment of a retroreflective device comprising macrocube corner elements as the signal means is disclosed in FIGS. 11–12 of the aforementioned U.S. Pat. No. 5,277, 513, and described in detail therein. In the presently preferred embodiment, the signal means 92 will be of a light-transmissive synthetic resin having a substantially smooth front face 95 and a plurality of retroreflective cube corner elements formed on its rear surface. As shown generally in FIG. 2 hereof, the signal means 92 includes a lens member 94 which may be a plastic with retroreflective macrocube corner elements formed therein (not shown). The lens member is preferably an air-gap style reflector welded to a backpiece of a similar material, and mounted in the housing member by means of a suitable adhesive, such as Lord Corporation's Versilock 406/19. Alternatively, signal means 92 can be mounted in pocket 76 by a mechanical interlock, discussed in more detail below.

The signal means 92 may have a glass plate having a front surface 96 applied over the front face 95, as taught in U.S. Pat. No. 5,277,513, and also in U.S. Pat. No. 4,340,319. Alternatively, front face 95 can be provided with some other coating or layer to provide a front surface 96 intended to provide resistance to abrasion, both from tires passing over the signal means and from "sandblasting" which can occur when abrasive wind-borne particulates are forced against a signal means surface by high-speed air currents caused by passing vehicles. Such a coating or layer can be an abrasion-resistant polymeric layer or a self-healing layer that restores itself to a smooth surface even after undergoing some abrasion.

The signal means 92 as used in a pavement marker of the instant invention will have an upper edge 97, (FIG. 2) generally disposed in a plane substantially parallel to the roadway surface. The front face 95 of signal means 92 generally comprises an upper portion 98 which may include as much as the upper two-thirds to three-fourths of the signal means front face, and the remainder, referred to herein as the lower portion 99 of the signal means front face. The signal means front face 95 has two lateral edges which intersect the signal means upper edge 97; the regions of the front face 95 in the vicinity of those intersections are referred to herein as the upper generally corner portions of the signal means front face, 100, 101 (FIG. 1).

The contact between an oncoming vehicle tire and a signal means disposed in a pavement marker of the instant invention will depend on factors such as the angle A between the signal means front face 95 and the pavement surface, and a parameter referred to herein as the "recess depth" of the signal means front surface, and indicated as x in FIG. 2. As shown in FIG. 2, the recess depth x is the distance between the front surface 96 of the signal means 92 and an imaginary line i parallel to front face 95 and intersecting an edge point on hood member 79, the recess depth K being measured as the length of the line segment normal to front face 95 and extending from front surface 96 to the parallel imaginary line i.

The recess depth selected will depend on the angle A of flat support surface 77; generally a smaller angle A will require a greater recess depth, and a larger angle A can be used with a smaller recess depth x. Generally, as Angle A varies between about 30°–40°, recess depth x can vary between about 0.120–0.090 inches, and one skilled in the art will recognize that a recess depth could be selected to allow angle A to be as low as about 20° or as high as about 60°.

Road-wheel machine tests of prior art pavement markers conducted with both car and truck tires, and for both on-center and off-center impacts, have confirmed that a significant amount of tire contact occurs at the upper edge and the upper generally corner portions of the signal means front face, particularly for off-center tire impacts. For markers in which the signal means front face is at an angle A of 30° and having a vertical dimension z of about 0.72–0.82 inch, it was found that a recess depth x of at least about 0.125 inch minimized tire contact with the upper portion 98 of the signal means front surface 96 while allowing tire contact with the lower portion of the signal means front surface 96. For markers in which the signal means front surface 96 is at an angle A of 40° and having a vertical dimension z of about 0.79–0.83 inch, it was found that a recess depth x of about 0.060 inch to up to about 0.140 inch would minimize tire contact with the upper portion 98 of the signal means front face 95 while allowing tire contact with the lower portion 99.

In installation of the pavement marker 30 on the pavement 20, the base member 40 must be embedded in the pavement so that the basal plane P of the base member 40 will lie substantially in the plane of the roadway surface 21. This necessitates that the bottom portions of the keel members 41 and 45 and the support member 60 respectively be recessed below the roadway surface 21 in corresponding generally complementary grooves or recesses in the pavement 20.

For the preferred embodiment illustrated herein, the pavement marker 30, and particularly the base member 40 thereof, can be constructed to facilitate the installation of the pavement marker 30 on the pavement 20 so that the support means 63 lies below the roadway surface 21, or plane P, thereby to minimize the height of the pavement marker 30 above the roadway surface 21 so as to maintain an angle of less than about 6° between the inclined ramp surfaces 52 and 53 and the roadway surface 21 while having an overall length of the pavement marker 30 of about 10 inches as disclosed in the aforementioned U.S. Pat. No. 5,277,513.

Figure 4:
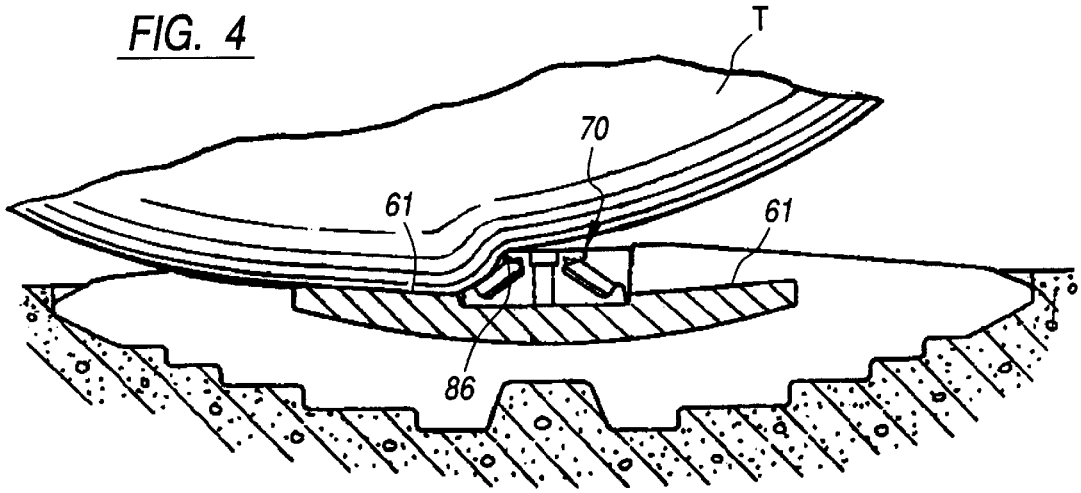
FIG. 4 illustrates the perceived impact of an oncoming vehicle tire against a snowplowable pavement marker of the instant invention and the contact of the tire on the lower portion of the signal means front face, the deformation of the tire being exaggerated for purposes of illustration.

The operation of the instant invention in controlling the impact of a tire of an oncoming vehicle is illustrated in FIG. 4. As a vehicle drives over the pavement marker, its tire T can pass between keel members 41, 45 and over signal means assembly 70. In so doing, tire T will impact front tire-directing surface 86 and convexed radiused conjunction 89 of protective hood member 79. As shown in FIG. 4, with the tire deformation exaggerated for purposes of illustration, front tire-directing surface 86 directs tire T away from the upper edge, upper portion, and upper generally corner portions of signal means front face 95. Tire T slightly deforms and is deflected not only from the upper edge of front surface 96, but from as much as the upper one-half to three-fourths of the front surface 96 of signal means 92. The protective hood member 79 thus protects signal means 92 from damage caused by the impact of tire T particularly in the upper portion 98 of signal means front surface 96, and particularly in the upper generally corner portions where damage most often occurs, especially during off-center impacts.

The instant invention, while minimizing contact of an oncoming tire with the upper edge, upper portion and upper generally corner portions of the front surface 96 of the signal means, nevertheless allows for some tire contact on the lower portion 99 of the signal means front surface 96. As shown in FIG. 4, protective hood member 79, acting in cooperation with keel members 41, 45, controls the impact of tire T against signal means front surface 96, such that tire effectively T wipes or cleans dirt and grime from the lower portion 99 of the front surface 96 of signal means 92, thus enhancing light-transmitting ability.

The snowplowable pavement marker of the instant invention preferably includes additional means intended to facilitate removal of debris from in front of the signal means front surface 96. As shown in FIGS. 1, 1A, such means can take the form of the aforementioned channels 55*a*, 55*b*, 55*c*, and 55*d*, extending through inclined ramp surfaces 52, 53 on either side of signal means 92 and with the inner ends of the channels situated longitudinally just in front of signal means 92. Rain or significant moisture that accumulates on inclined recesses 61 and in front of signal means 92 can drain away through the channels 55*a, b, c*, and *d*. In addition, a tire passing over the pavement marker 30 will drive streams of moisture under pressure through the channels 55*a, b, c*, and *d* and away from signal means 92, to further facilitate drainage of fluid that would otherwise accumulate on inclined recesses 61 in front of the lower portion of the signal means front face. Each channel is wide enough to permit sufficient water to drain therethrough, yet narrow enough so that a snowplow blade passing over the pavement marker ramps 52, 53 will not be caught on the upper edges of the channel. Those skilled in the art will determine optimum dimensions of the channel depth, width, and angle with respect to the longitudinal direction for various embodiments of the instant invention. For the illustrated embodiment, the channel width is about 0.325 inches and its depth is about 0.275 inches.

Signal Means Assembly/Base Member Interlock

As described above, the signal means assembly 70 may be mounted to base member 40 by means of a suitable adhesive, such as is known in the prior art. The instant invention further contemplates other means for releasably securing a signal means assembly to a support means of a pavement marker base member.

It is recognized that base members formed as metal castings for snowplowable pavement markers have a useful life longer than the roadway surface into which they are installed, and need not be replaced during the life of the roadway. A signal means such as a retroreflective element, however, even when used with the protective tire-directing hood member of the instant invention, may nonetheless be subject to some damage, breakage, abrasion or other factors which could decrease light transmission. Depending on traffic conditions and on the presence of abrasive materials, tire studs, embedded stones in tires and the like, retroreflective signal means in pavement markers typically must be replaced every few years. The need for a signal means readily removable from a pavement marker base member has long been recognized in the art, and one early disclosure of a removable assembly is found in the aforementioned U.S. Pat. No. 3,485,148.

Experience has shown that when a signal means assembly has been mounted on a base member by means of an adhesive, such as a pressure sensitive adhesive pad or a construction adhesive, the procedure for removing the signal means can be labor-intensive. The procedure will generally include the steps of prying out the old signal means, such as with a screwdriver; removing any remaining broken parts; scraping residual adhesive off the base member surface; removing rust from the base member by wire brushing or sandblasting; applying fresh adhesive; setting the new signal means in place; and setting the signal means to the proper height with respect to the base member. It would be desirable to have a base member/signal means assembly system for use in the instant invention in which the signal means assembly could be replaced quickly, easily, and inexpensively.

Applicants have discovered that a connection such as a mechanical interlock or an interference fit allows a signal means assembly to be positively retained on a base member, even when subjected to shear forces from oncoming traffic, yet also allows it to be replaced more quickly and easily than when an adhesive system is used. Such a connection can generally comprise a first interlock means on the signal means assembly, and a second interlock means on the support means, the first and second interlock means cooperating to provide a mechanical connection between the signal means assembly and the support means, and to facilitate removal of said signal means assembly from said base member and installation of a replacement signal means assembly.

Figure 5A:
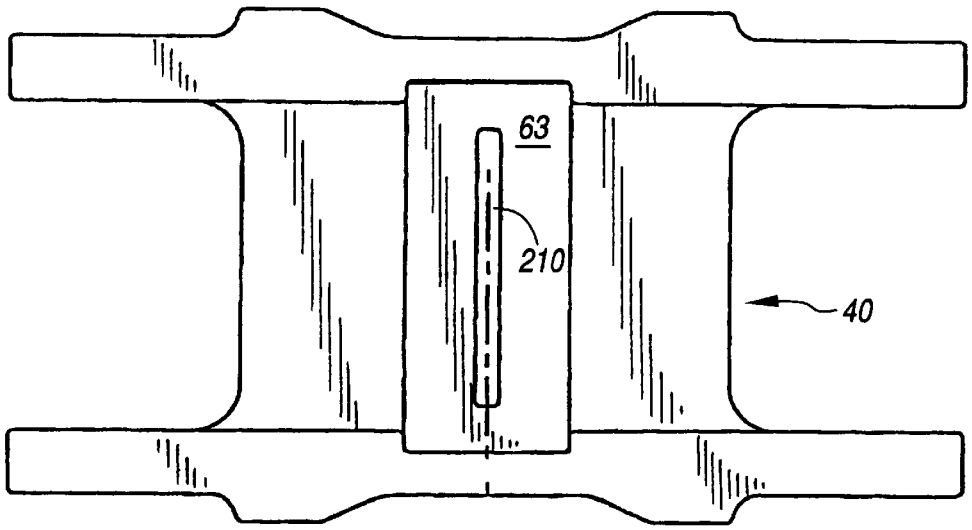
FIGS. 5A–5E illustrate an embodiment of a snowplowable marker of the instant invention wherein a signal means assembly is retained on the base member by means of a mechanical interlock.
Figure 5B:
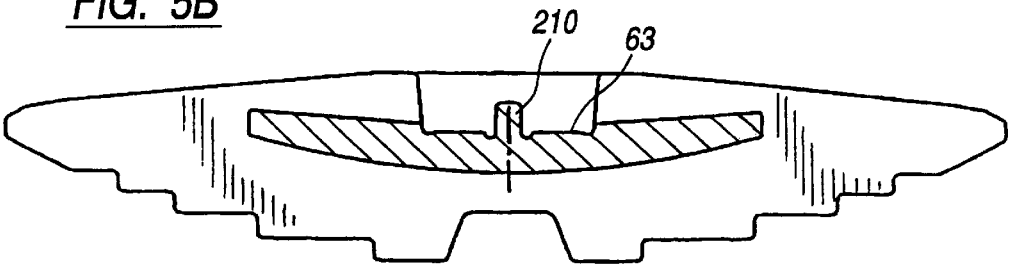
Figure 5C:
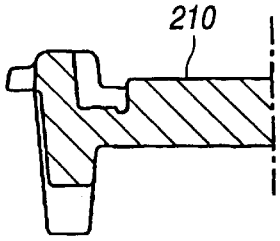
Figure 5D:
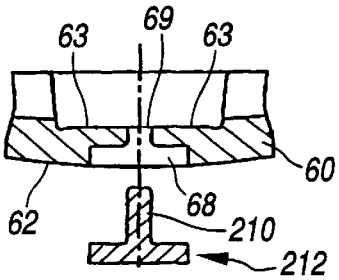

In one embodiment of this feature of the invention as shown in FIGS. 5A–E, a projection 210 extends upwardly from the support means 63 of the base member 40 and fits into a corresponding recess in bottom flat surface 74 of signal means assembly housing member 72 (not shown). The fit of projection 210 into the corresponding recess is an interference fit, strong enough to secure signal means assembly 70 to base member 40 in roadway traffic. In its simplest form, projection 210 can be in the form of a single continuous transverse rail which can be integrally formed and unitary with base member 40, as illustrated in top plan view in FIG. 5A, and in side cross-sectional view and longitudinal views in FIGS. 5B and 5C, respectively. It is recognized, however, that the close tolerances required for a secure interference fit between the base member and the signal means assembly could be difficult to achieve with metal castings of which snowplowable base members are made. Therefore, as an alternative embodiment of the mechanical interlock, projection 210 can be formed integrally with an insert member 212 which can be made of a material such as aluminum or tough plastic which can be manufactured into parts having close tolerances. In one embodiment, insert member 212 can be made in the shape of a member with an "inverted T" shaped cross-section, as shown in FIG. 5D, and fitted into a complementarily shaped recess 68 formed into support member 60 and having an opening 69 in support means 63, such that projection 210 extends upwardly through opening 69 to provide a means for a mechanical interlock with the complementary recess in the signal means assembly (not shown).

In this embodiment, insert member 212 can be secured to support member 60 by known means such as adhesives, welding, or other suitable assembly techniques; it will be appreciated that insert member 212 also will be positively retained in position in base member 40 by means of the adhesive which secures pavement marker 30 in roadway surface 20, which adhesive will extend across arcuate part-cylindrical bottom surface 62 of support member 60 when the pavement marker is installed.

Figure 5E:
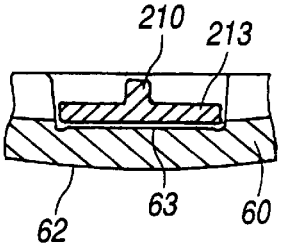

For pavement marker base members that are not provided with a recess 68, an alternative embodiment of an insert member designated as 213 can be manufactured of a strong material having close tolerances and fitted directly onto support means 63 and bonded thereto, such as by welding or by an appropriate permanent adhesive, and generally illustrated in FIG. 5E. This embodiment allows previously used base members to be retrofitted with signal means assemblies employing the mechanical interlock system of the instant invention.

Figure 6A:
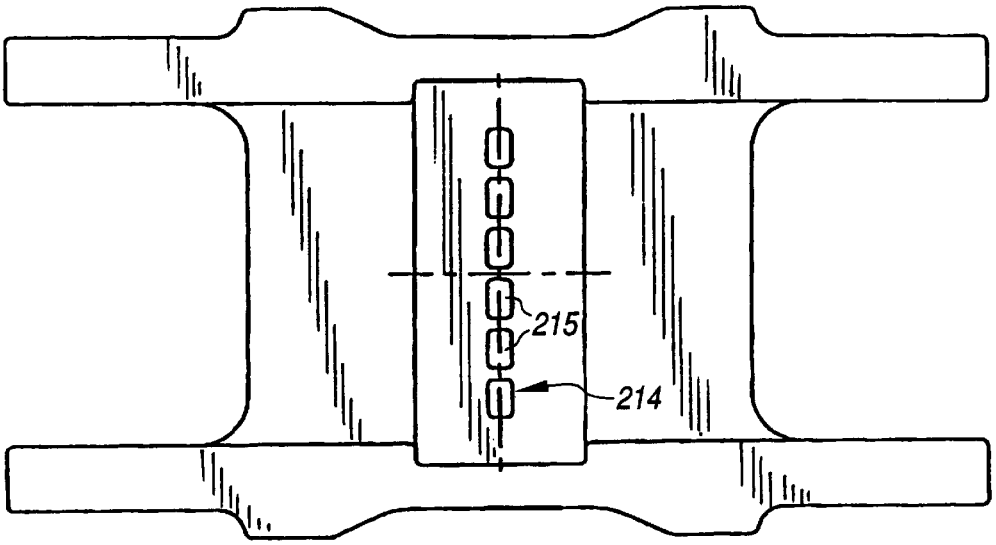
FIGS. 6A–6E illustrate an alternative embodiment of a mechanical interlock between a base member and a signal means assembly.
Figure 6B:
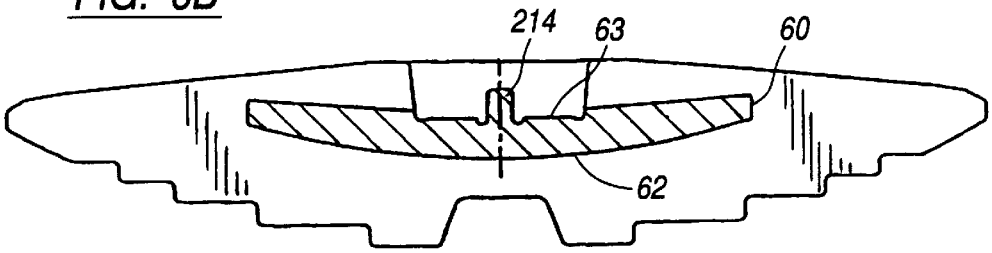
Figure 6C:
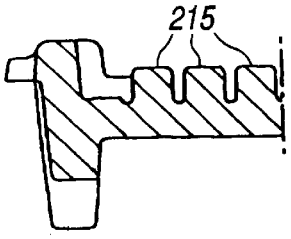
Figure 6D:
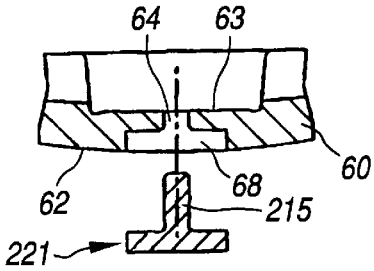
Figure 6E:
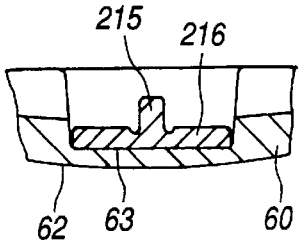

In an alternative embodiment of a mechanical interlock system of the instant invention as illustrated in FIGS. 6A–E, the upwardly projecting member is a segmented transverse rail 214, rather than a single continuous rail. Each segment 215 of segmented rail 214 fits into a corresponding recess in bottom flat surface 74 of signal means assembly 70 (not shown). The fit of projection segments 215 into the corresponding recesses is an interference fit, and it is believed that a plurality of projection segments 215 and a plurality of corresponding recesses may provide improved retention of signal means assembly 70 to base member 40, as compared to the single continuous rail of the embodiment illustrated in FIGS. 5A–E. The upwardly extending segments 215 can be integrally formed in the support means 63 of base member 40, as shown in top plan view in FIG. 6A and in side cross-sectional and longitudinal views in FIGS. 6B and 6C respectively. Alternatively, upwardly extending segments 215 can be formed as part of a separate insert member 221 which extends upwardly through recess 68 and opening 69 in support means 63, as shown in FIG. 6D and in a manner analogous to that described with respect to the embodiment of FIG. 5D, or, as a separate insert member 216 which is mounted on base member 40, as shown generally in FIG. 6E, and in a manner analogous to that described with respect to the embodiment of FIG. 5E. Material choices will be guided by the same factors as are described for the embodiment of FIGS. 5A–E.

Figure 7A:
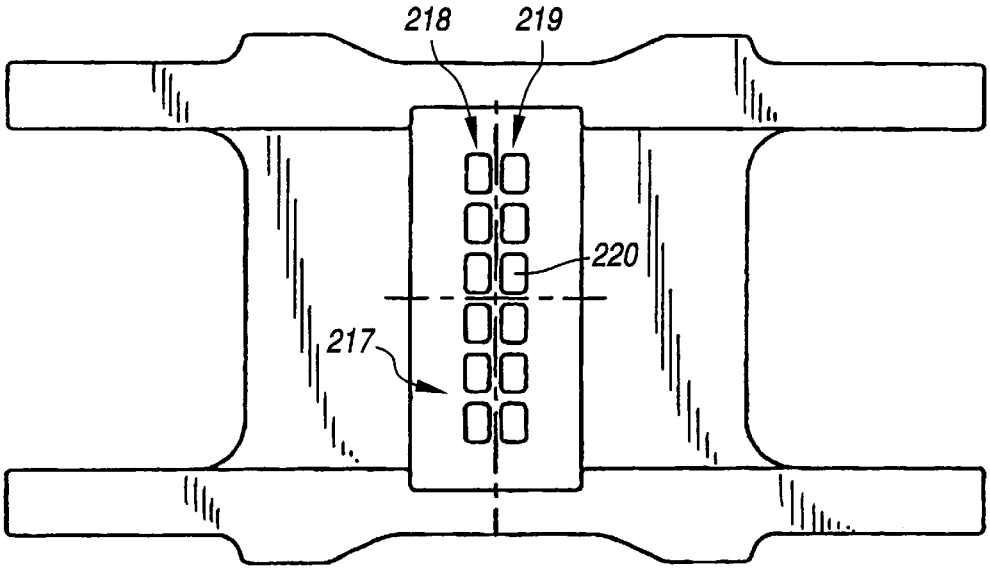
FIGS. 7A–7E illustrate yet another alternative embodiment of a mechanical interlock between a base member and a signal means assembly.
Figure 7B:
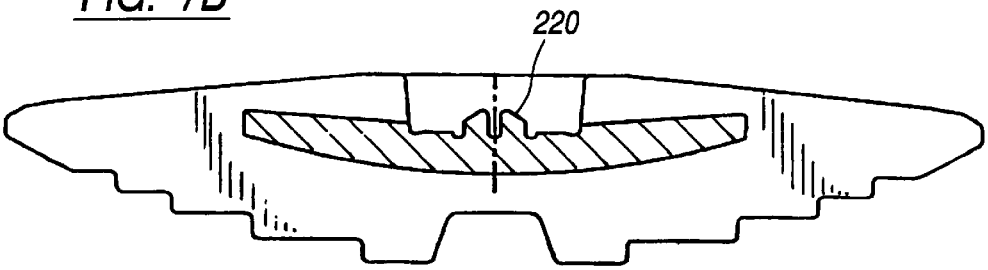
Figure 7C:
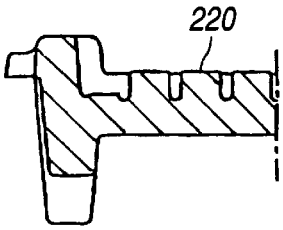
Figure 7D:
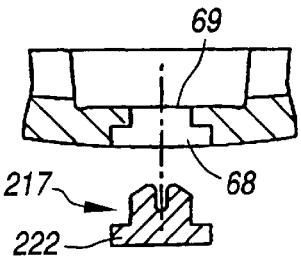
Figure 7E:
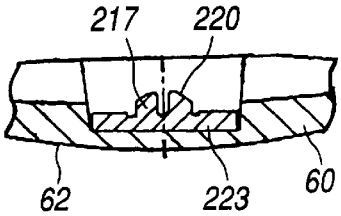

In yet another alternative embodiment illustrated in FIGS. 7A–E, the upwardly projecting member is a double segmented transverse rail 217, having two rows 218 and 219 of upwardly projecting segments 220. As with the embodiments of FIGS. 5A–E and 6A–E, the projecting segments 220 can be integrally formed as part of support surface 63 of base member 40, as illustrated in FIGS. 7A–7C, or the segments 220 can be part of a separate insert member 222 as shown in FIG.7D analogous to the inserts 212, 221 of FIGS. 5D and 6D, respectively. In this embodiment, the corresponding recess 68 formed in bottom surface 62 of support means 63 and the opening 69 therethrough will accommodate the two rows 218 and 219 of projecting segments 220, as shown in FIG. 7D. For base members not having such a recess, an insert member 223 can be mounted on top of support means 63 as shown in FIG. 7E.

It will be appreciated that the drainage channels 55*a, b, c*, and *d* have been omitted from FIGS. 5A, 6A and 7A for the sake of clarity, but that such embodiments optionally including said drainage channels are contemplated as being within the scope of the present invention.

Figure 8A:
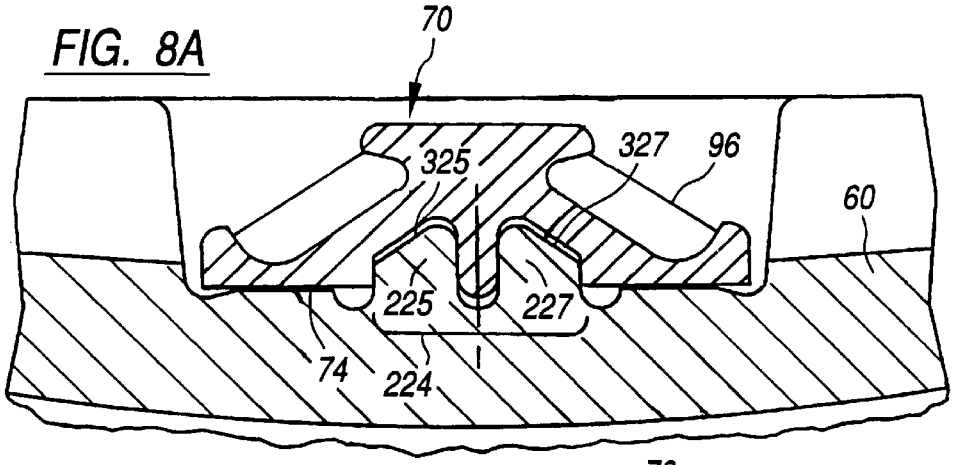
FIG. 8A–8D illustrate still other alternative embodiments of mechanical interlocks between a base member and a signal means assembly.

FIG. 8A illustrates a cross-sectional view of still another alternative embodiment wherein the upwardly extending projection 224 is in the form of double continuous transverse rails 225, 227. FIG. 8A further illustrates the signal means assembly 70 having corresponding recesses 325, 327 in the bottom surface 74 and which provide an interference fit with transverse rails 225, 227. While FIG. 8A illustrates the embodiment wherein the projection 224 is integrally formed with support means 63 of base member 40, it will be appreciated that projection 224 could also be a separate insert member extending upwardly through a recess in support means 63 or mounted on top of support means 63.

Figure 8B:
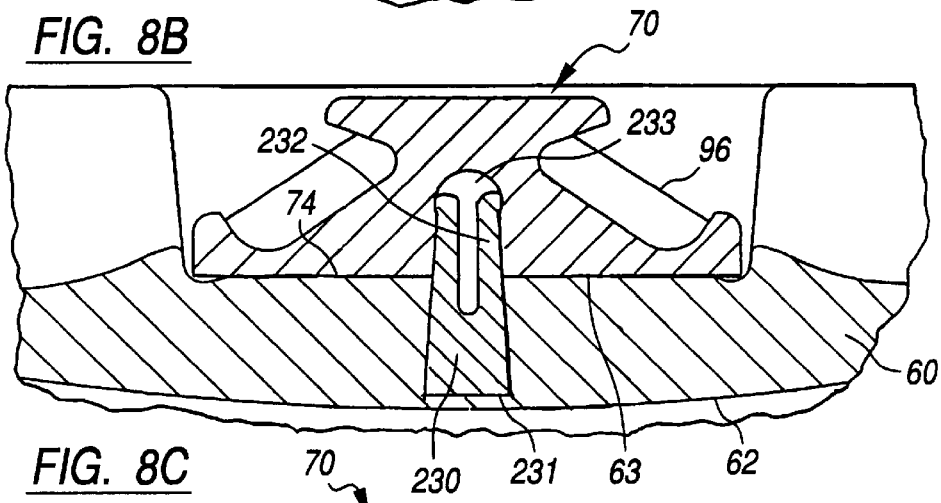
Figure 8C:
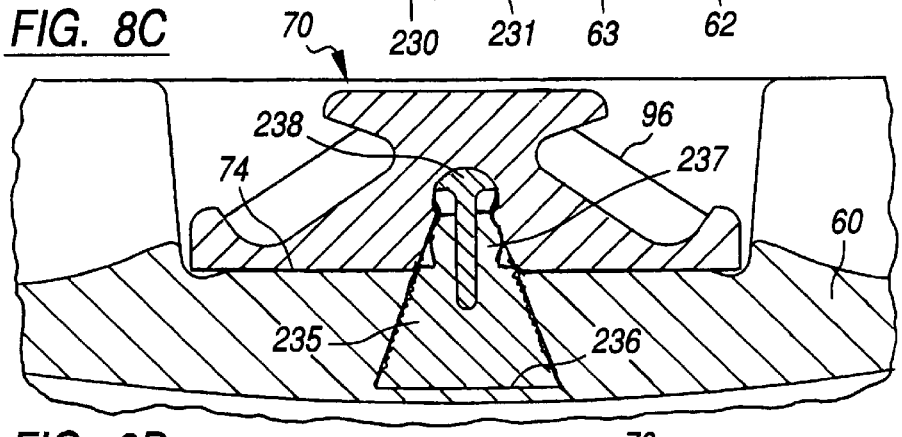
Figure 8D:
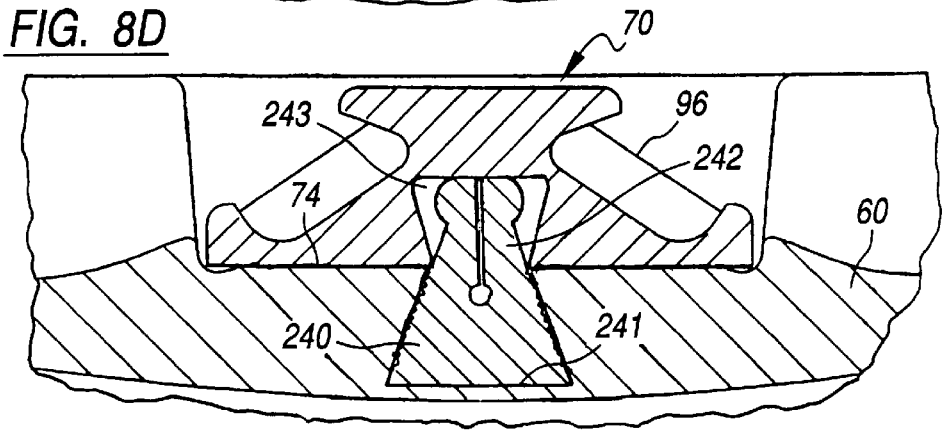

FIGS. 8B, 8C, and 8D illustrate still other alternative embodiments of mechanical interlocks between a signal means assembly 70 and a pavement marker base member 40. In these embodiments, the base member 40, and in particular the support member 60 thereof, is cast in place around an insert member illustrated at 230, 235, and 240, in FIGS. 8B, 8C, and 8D, respectively. FIGS. 8C and 8D illustrate embodiments in which the transverse walls of the insert members 235, 240 are grooved or serrated to increase the frictional fit between the insert member and the support member 60. The insert members 230, 235, and 240 have relatively broad bases 231, 236, and 241 and taper upwardly until they terminate in upwardly extending double rails 232, 237, and 242. Each signal means assembly is provided in its bottom surface with a corresponding recess 233, 238, and 243. Each corresponding recess is configured generally to complement the shape of the upwardly extending double rails, such that when the double rails are inserted into the recess the rails will be under compression forces, causing the rails to urge against the sides of the recess to strengthen the interlock between the signal means assembly and the base member. In particular, these embodiments will provide improved resistance to shear forces caused by vehicles passing over the pavement marker, which shear forces would otherwise tend to dislodge the signal means assembly 70 from the pavement marker base member 40.

In each of the foregoing embodiments illustrated in FIGS. 5A–E, 6A–E, 7A–E, and 8A–D, it is to be understood that mating parts can be reversed between the base member 40 and the signal means assembly 70, such that projections can extend downwardly from the signal means assembly 70 and recesses can be formed or affixed to base member 40; or, so that base member 40 and signal means assembly 70 can each have projections and corresponding mating recesses. It further will be understood that the materials chosen for each of the embodiments shown will be selected on the basis of toughness and ability to be manufactured to the tolerances required for the particular embodiment, which properties will be understood by those of ordinary skill in the art.

Figure 9A:
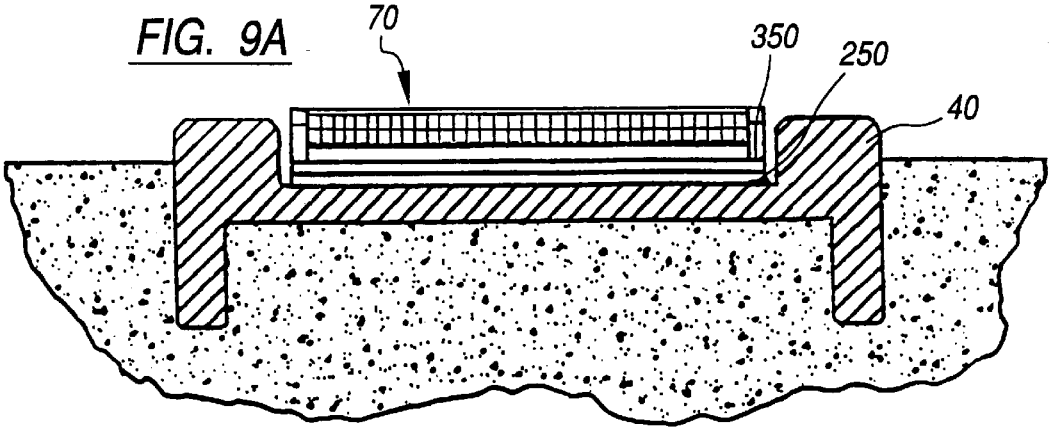
FIGS. 9A–9D illustrate various embodiments of a pavement marker of the instant invention wherein the mechanical interlock between the base member and the signal means assembly is provided by opposed mating strips of interconnecting structures.
Figure 9B:
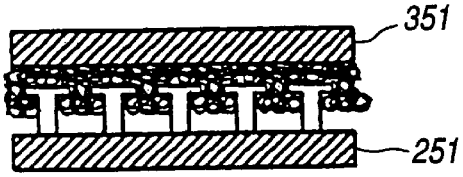
Figure 9C:
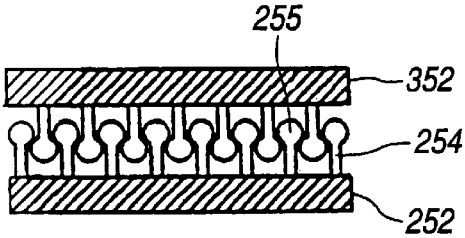
Figure 9D:
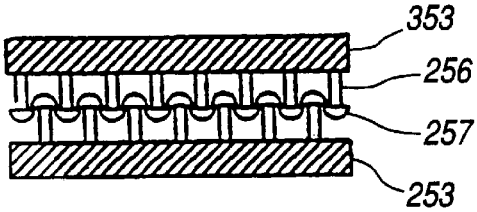

Another type of mechanical interlock system suitable for securing a signal means assembly to a base member in a pavement marker of the instant invention is illustrated generally in FIG. 9A and more specifically in FIGS. 9B, 9C and 9D. Two strips 250, 350 of mutually interlocking material are fixedly adhered to support means 63 of base member 40 and bottom surface 74 of signal means assembly 70, respectively. When the two opposing strips 250, 350 are pressed together in mating relationship, they provide a mechanical connection between signal means assembly 70 and base member 40 strong enough to withstand the shear forces that will be applied to the pavement marker in the longitudinal direction by oncoming vehicle tires. Nevertheless, the signal means assembly can be easily removed from the base member by applying an upward force to the signal means assembly, such as with a specially designed removal tool discussed below.

In one embodiment of the system of FIG. 9A, mutually interlocking strips 250, 350 may be of the hook-and-loop variety commonly available under the trademark VELCRO®, and illustrated generally in FIG. 9B. In this embodiment, hooks extending from hook-bearing strip 251 releasably engage loops on loop-bearing strip 351. In the embodiment illustrated in FIG. 9C, strips 252, 352 are substantially identical strips of plastic sheeting, each bearing a plurality of molded rods 254 extending therefrom, each rod 254 having at its distal end a ball 255 larger in diameter than the rod 254. As shown in FIG. 9C, when the two strips are pressed together in mating relationship, the balls 255 of the two mating strips will mechanically interlock to resist separation by shear forces. FIG. 9D illustrates an embodiment similar to that of FIG. 9C and wherein mutually interlocking strips 253, 353 each have a plurality of rods 256 extending therefrom, and wherein the ends of the rods 256 are provided with hemispheres 257 rather than balls; it is believed that the hemispheres 257 may offer greater resistance to applied shear forces and thus improved retention of signal means assembly 70 on pavement marker 40 in use.

Figure 10A:
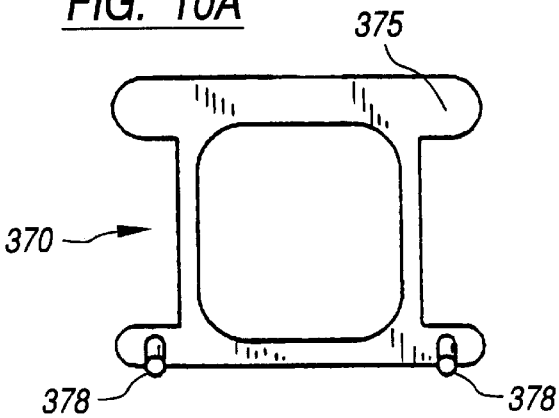
FIGS. 10A–10B are front end side views, respectively, of a tool suitable for use in removing a signal means assembly mechanically interlocked to a base member in the pavement marker of the instant invention.
Figure 10B:
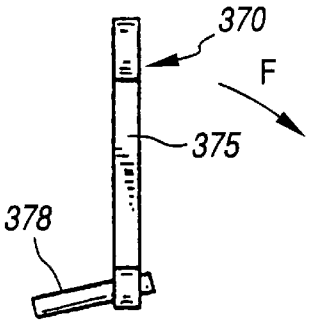

When any of the mechanical interconnection systems as illustrated in FIGS. 5–9 is used, removal of the signal means assembly 70 from base member 40 will be facilitated by use of the removal tool 370 illustrated in FIGS. 10A, 10B. Tool 370 comprises a frame 375 having two projecting studs 378. To remove signal means assembly 70 from a corresponding base member 40, studs 378 are inserted beneath signal means 70, between the lower surface 74 thereof and support surface 63. Slots to accommodate studs 378 may be preformed in the inclined recesses 61 adjacent support surface 63, as in the prior art Stimsonite® Model 98 pavement marker. Once the studs 378 are in position, the user applies a downward and rearwardly directed force generally in the direction of the curved arrow "F" shown in FIG. 10B. This will cause studs 378 to apply an upward force to signal means assembly 70 in a prying or "crowbar" effect, and will allow the removal of the signal means assembly 70 from the base member 40 without breakage of the assembly. There will be no adhesive to clean off the base member 40, or broken pieces of signal means assembly to pry away. Moreover, base member 40 will be ready to receive a new signal means 70, without any substantial reconditioning.

Other Snowplowable Embodiments

Figure 11A:
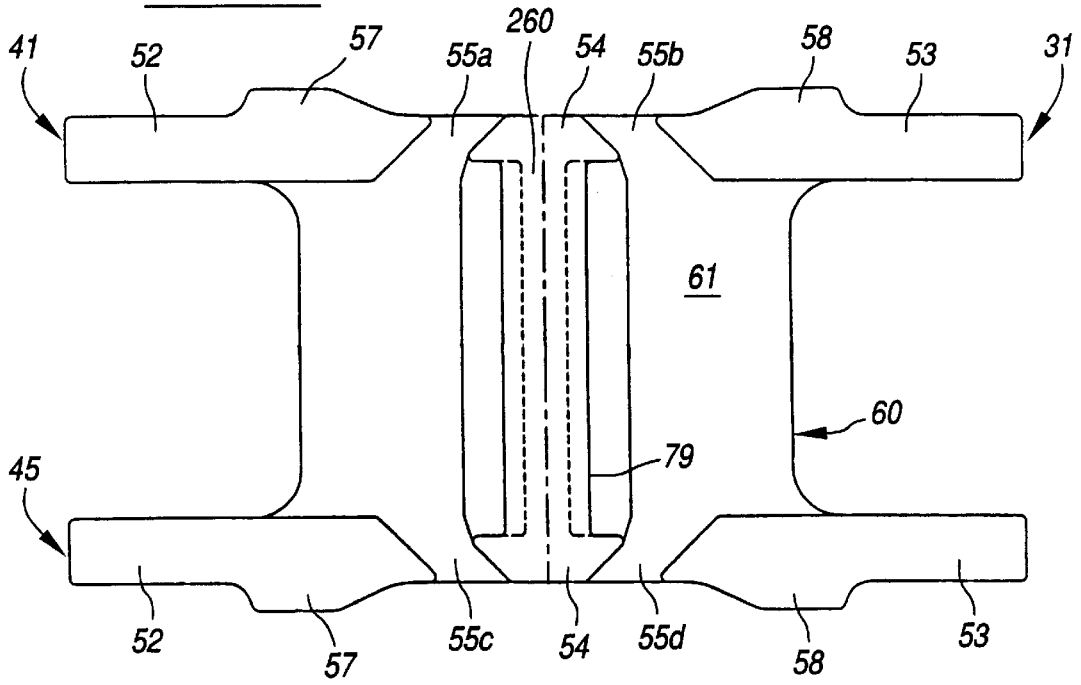
FIG. 11A is a top plan view of an alternative embodiment of a bidirectional snowplowable pavement marker base member of the instant invention being unitary with the protective tire directing hood member.
Figure 11B:
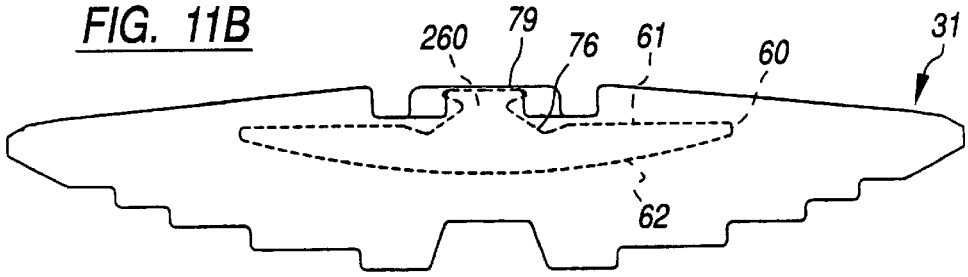
FIG. 11B is a side cross-section view of the base member embodiment of FIG. 11A.
Figure 11C:
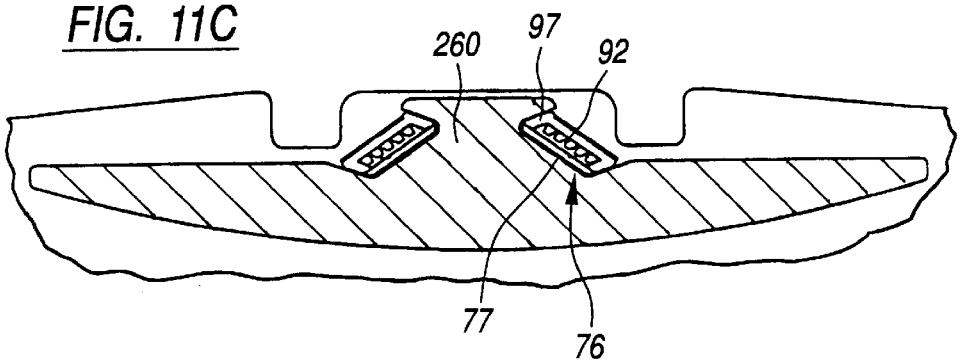
FIG. 11C is a detail showing a signal means placed in the embodiment of FIG. 11B.

Other embodiments of snowplowable pavement marker base members can be made which incorporate the protective longitudinally extending tire-directing hood member of the instant invention. For example, the hood member can be unitary with the pavement marker base member, rather than being part of a separate signal means assembly. FIG. 11A is a top plan view and FIG. 11B is a side cross-sectional view of a base member 31 for a bidirectional snowplowable pavement marker of a construction substantially similar to the embodiment of FIG. 1, but wherein longitudinally extending hood member 79 and signal means pockets 76 are unitary with upwardly projecting center bar 260. This embodiment can optionally include the channels 55*a, b, c, d* which facilitate drainage of accumulated fluid from the areas of support member 60 in front of signal means 92. FIG. 11C is an enlarged view of unitary center bar 260 and showing signal means 92 mounted in signal means pockets 76. It may be seen that tire-directing hood member 79 extends longitudinally over and forward of the upper edge 97 of signal means 92. Signal means 92 can be mounted in signal means pocket 76 by means of an adhesive, or flat support surface 77 of signal means pocket 76 and the rear surface of signal means 92 can be provided with mutually cooperative strips of interlocking material similar to the strips 250, 350 used to interlock the signal means assembly to the base member and illustrated in various embodiments in FIGS. 9A–D. The use of such interlocking strips of material facilitates the removal of damaged or broken signal means from base member 40 and the installation of replacement signal means therein.

Figure 12A:
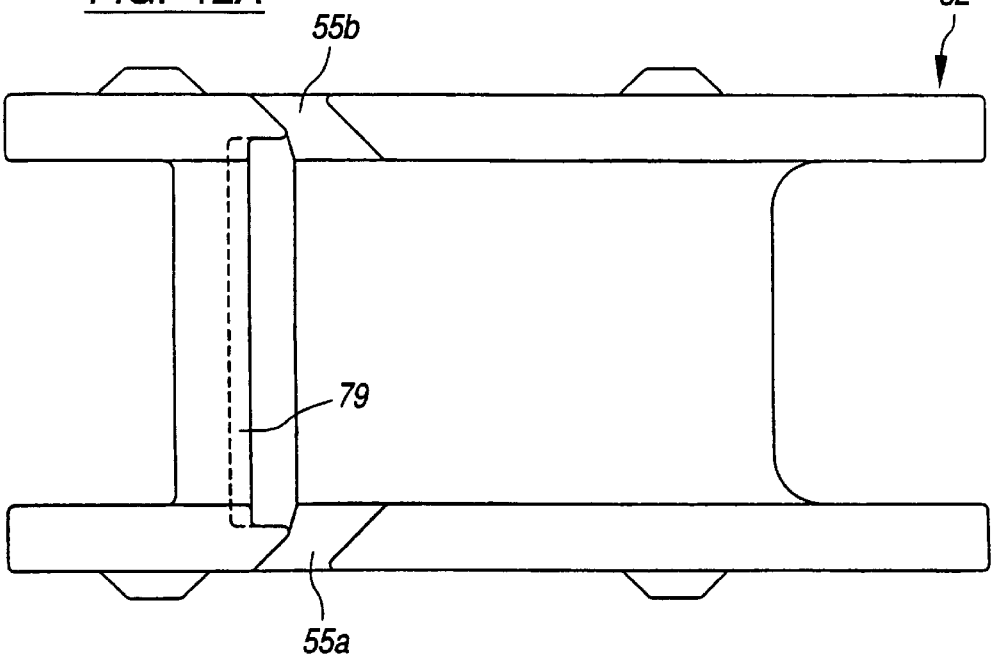
FIG. 12A is a top plan view of an alternative embodiment of a mono-directional snowplowable pavement marker base member of the instant invention being unitary with the protective tire-directing hood member.
Figure 12B:
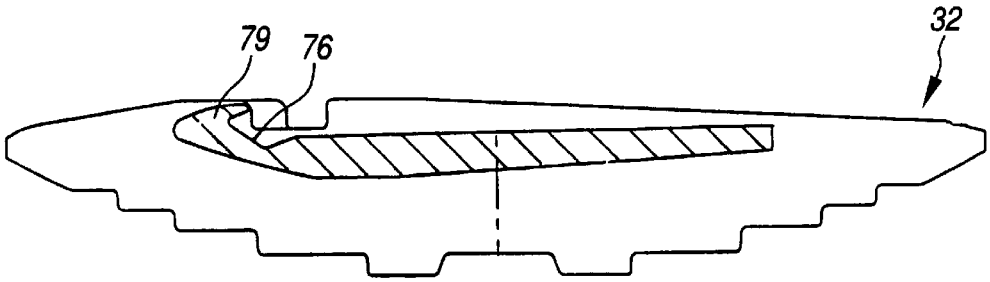
FIG. 12B is a side cross-section view of the base member embodiment of FIG. 12A.
Figure 12C:
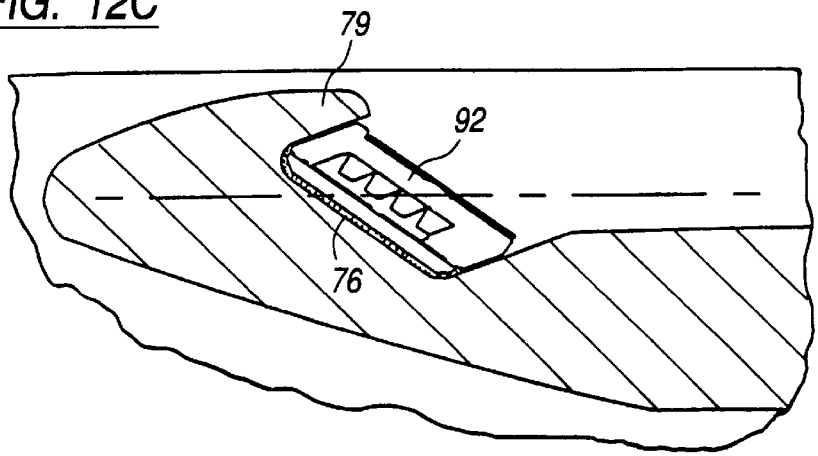
FIG. 12C is a detail showing a signal means placed in the embodiment of FIG. 12B.

As another alternative embodiment of the instant invention, FIG. 12A is a top plan view and FIG. 12B is a side cross-sectional view of a mono-directional low-profile base member 32 having a unitary longitudinally extending protective tire-directing hood member 79. Mono-directional snowplowable markers of the prior art are described in commonly assigned U.S. Pat. No. 5,257,875, incorporated herein by reference in its entirety. As shown in FIG. 12A, a mono-directional base member made in accordance with the instant invention can also include channels 55*a, b* to facilitate drainage of fluid that accumulates in front of the signal means 92. FIG. 12C is an enlarged cross-sectional view of this embodiment showing signal means 92 positioned in signal means pocket 76. Signal means 92 can be secured therein either by an adhesive or by means of mutually cooperative strips of interlocking material.

Figure 13A:
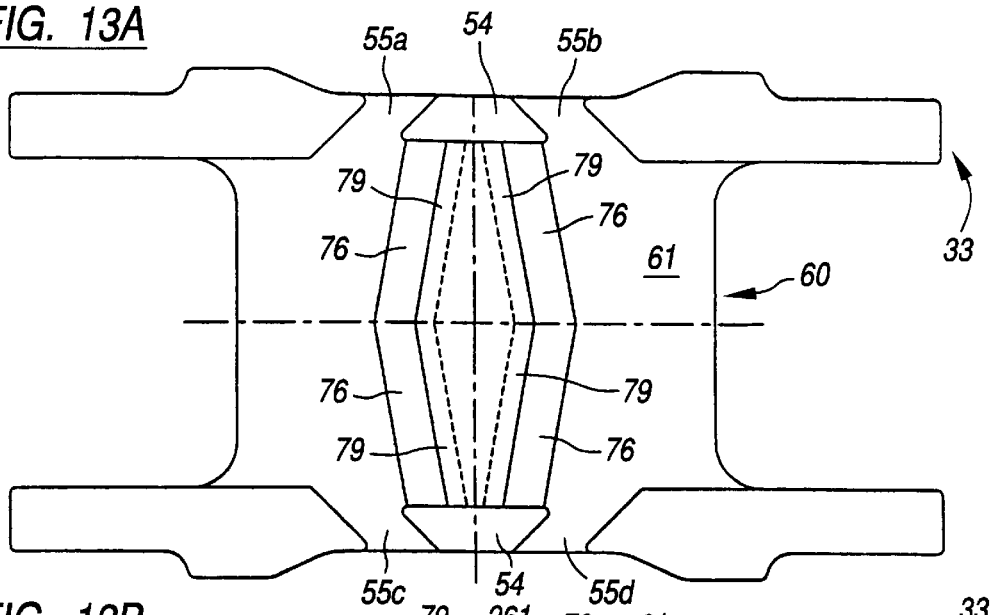
FIG. 13A is a top plan view of an alternative embodiment of a snowplowable pavement marker base member having a unitary protective tire-directing hood member wherein the signal means front faces are canted away from oncoming traffic.
Figure 13B:
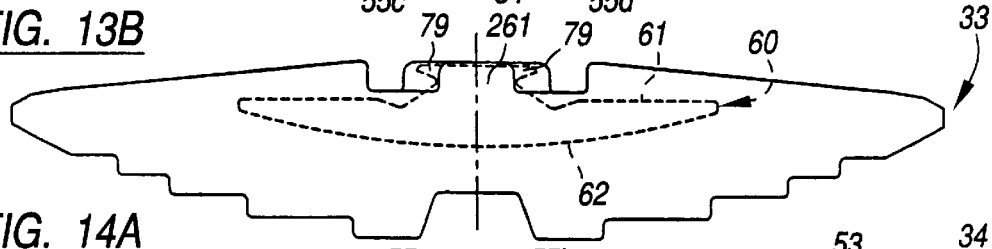
FIG. 13B is a side cross-section view of the embodiment of FIG. 13A.

FIGS. 13A and 13B illustrate top plan and side cross-sectional views respectively, of a base member 33 of a bidirectionally snowplowable pavement marker of the instant invention having a longitudinally extending protective tire-directing hood member 79 unitary with base member 33 and extending from center bar 261 thereof; in this embodiment the signal means pockets 76 formed in center bar 261 and the signal means carried thereby are canted away from oncoming traffic; it is currently believed that such a configuration may provide additional protection to the upper portions of the front faces of the signal means. This embodiment can also be provided with channels 55*a, b, c, d* to facilitate drainage of fluid that accumulates in front of the signal means.

Figure 14A:
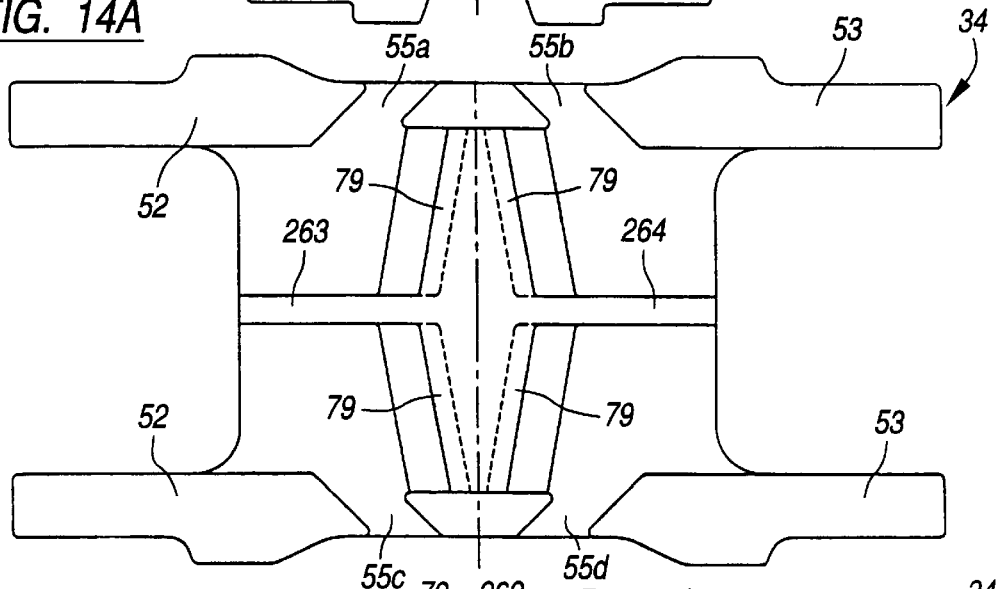
FIG. 14A is a top plan view of an alternative embodiment of the snowplowable pavement marker base member of FIG. 13A and further including a center ramp member to further protect the signal means from oncoming snowplow blades.
Figure 14B:
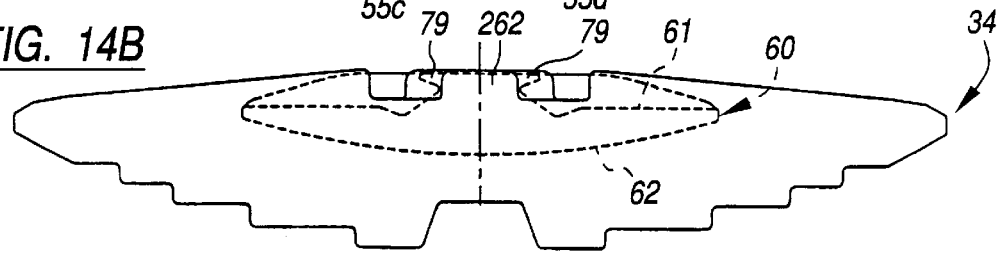
FIG. 14B is a side cross-section view of the base member embodiment of FIG. 14A.

FIGS. 14A and 14B illustrate top plan and side cross-sectional views, respectively, of an embodiment of a base member 34 of a pavement marker of the instant invention similar to the embodiment of FIGS. 13A and 13B, having a center bar 262 from which protective hood member 79 extends longitudinally, and further including third inclined surfaces 263 and 264, disposed between laterally spaced-apart inclined surfaces 52,52, and 53,53, respectively, and extending longitudinally upwardly toward center bar 262.

Figure 15A:
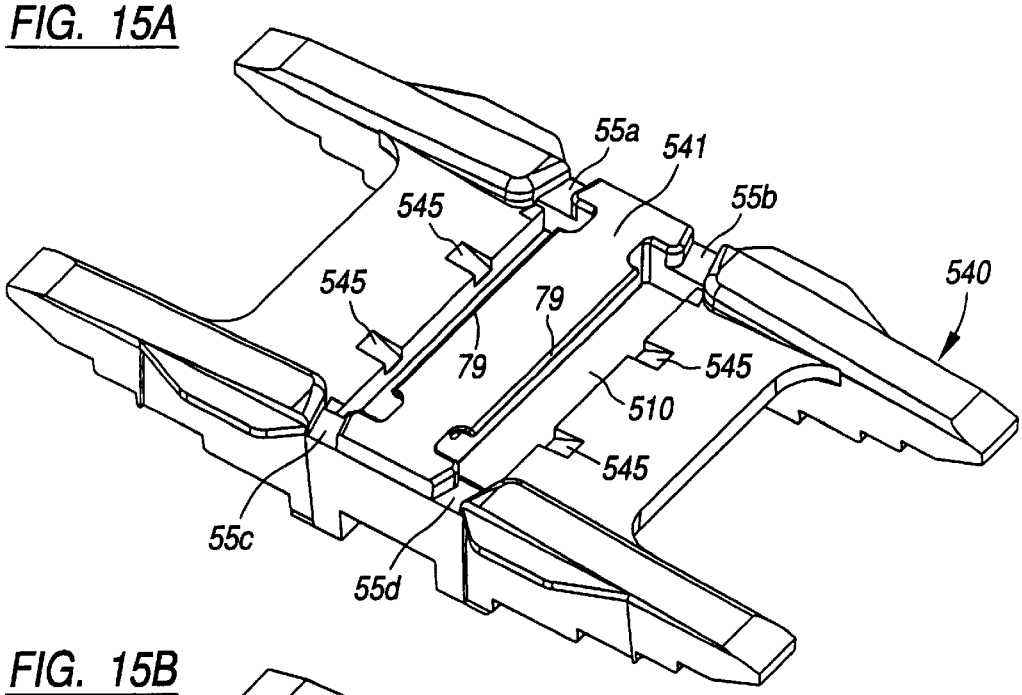
FIG. 15A is a perspective view of a snowplowable pavement marker base member of the instant invention having a unitary protective tire-directing hood member and having a receiving means for a separate non-unitary support means for a signal means assembly.

FIGS. 15A–E illustrate another embodiment of a mechanical interlock system for a signal means assembly that can be used in a pavement marker of the instant invention. The embodiment of pavement marker base member 540 of FIG. 15A is similar to the embodiment of FIG. 11A in that it is a bidirectional pavement marker having longitudinally extending protective tire-directing hood members 79 extending from and unitary with center bar 541, and having channels 55*a, b, c* and *d* formed in the base member 540 to facilitate drainage of fluid that accumulates in front of the signal means front face. In the embodiment of FIGS. 15A–E, the signal means 92 is retained in the base member 540 with a mechanical interlock system, the marker comprising a support means 563 not unitary with base member 540 and having a first interlock means 566, and a signal means assembly 570 comprising a signal means 92 and a housing member 571, the housing member 571 having a second interlock means that cooperates with said first interlock means to resist separation of the signal means assembly 570 from the base member 540 by applied shear forces, while facilitating removal of a damaged or broken signal means assembly and installation of a replacement signal means assembly. The support means 563 and housing member 572 will be made of a material capable of being manufactured to close tolerances in order to provide secure frictional engagement therebetween.

Figure 15B:
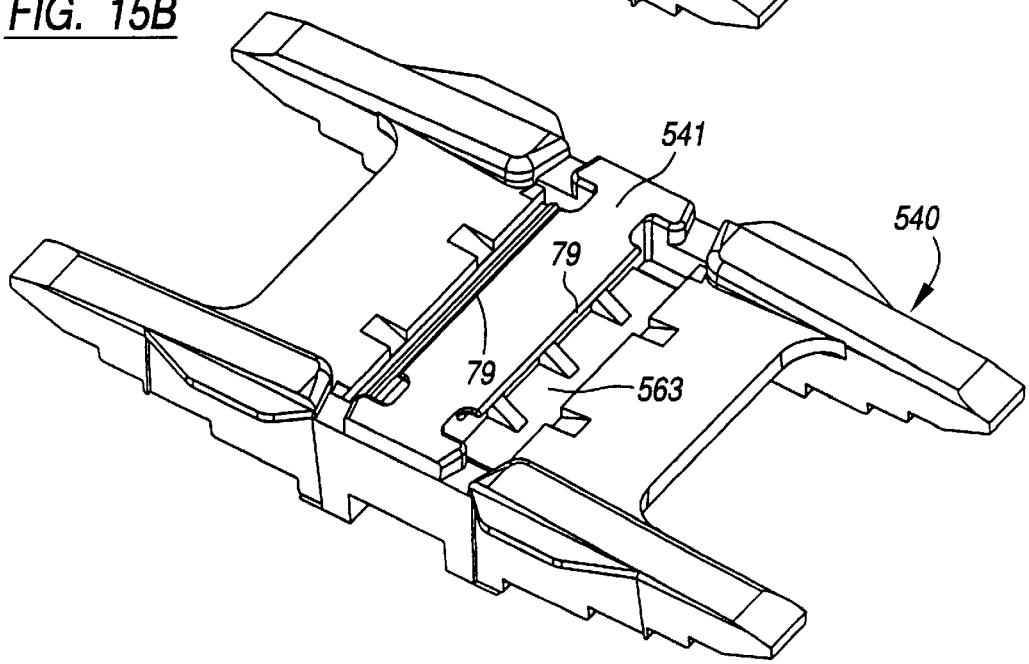
FIG. 15B is a perspective view of the base member of FIG. 15A and having a support means installed in the receiving means.
Figure 15C:
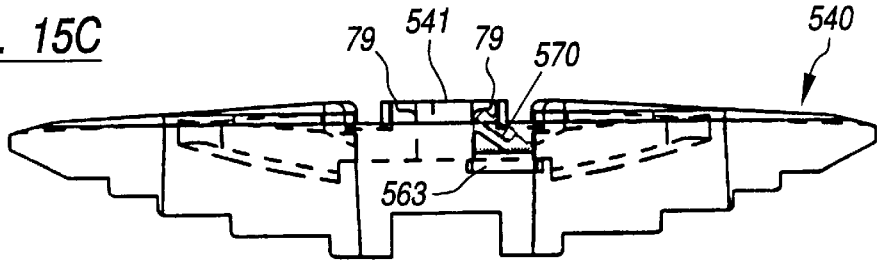
FIG. 15C is a side view of the base member with the support means of FIG. 15B.
Figure 15D:
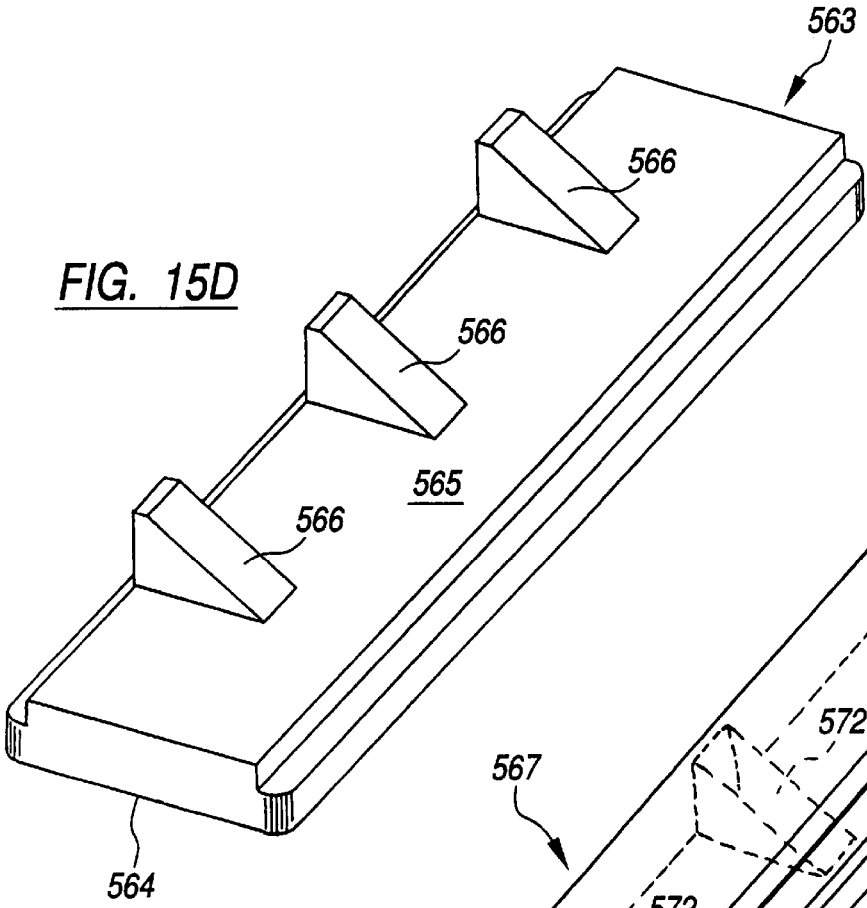
FIG. 15D is a perspective view of the support means to be installed in the base member of FIG. 15A.

Support means 563 is structured and dimensioned to be received in corresponding opening 510 in base member 540 in snap-fitting relation. FIG. 15A illustrates base member 540 without support means 563 in place, showing empty opening 510, FIG. 15B is a perspective view of base member 540 with support means 563 installed in opening 510, FIG. 15C is a cross-section view of base member 540 with support means 563 installed, and FIG. 15D is an enlarged perspective view of support means 563. Support means 563 includes a substantially flat bottom surface 564 that is substantially coplanar with the adjacent bottom surface of base member 540 when support means 563 is installed in opening 510 in snap-fitting relation. Additional securement of support means 563 to base member 540 will be provided by the adhesive used to secure base member 540 in the associated roadway surface. Bottom surface 564 of support means 563 can be provided with a plurality of adhesive receiving cavities, not shown, to further secure support means 563 in the adhesive and in relation to base member 540. Support means 563 further includes a top surface 565 which supports an interlock means, which in this embodiment comprises a plurality of laterally spaced apart upwardly extending angular projections 566.

Figure 15E:
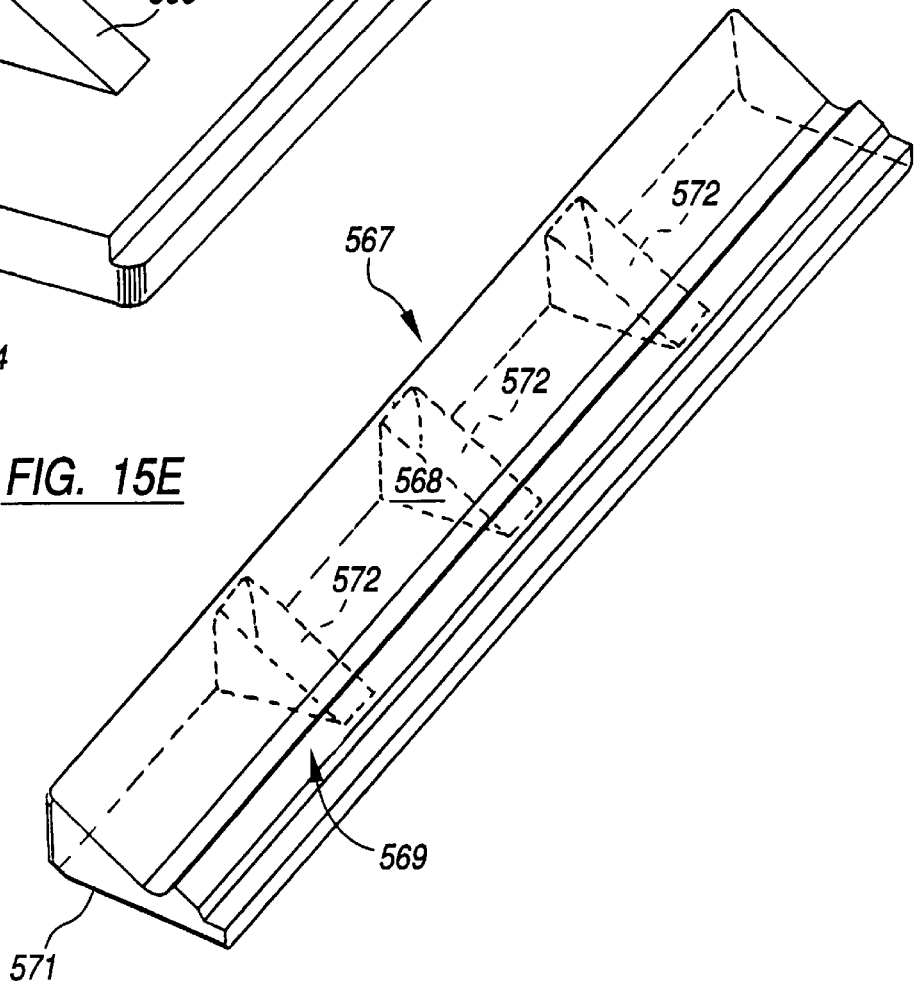
FIG. 15E is a perspective view of a signal means assembly housing that can be mounted by mechanical interlock on the support means of FIG. 15D.

FIG. 15E is a front perspective view of a housing 567 for a signal means assembly for this embodiment. The housing 567 includes flat surface 568 inclined such that a signal means 92 supported thereby will be maintained at a desired angle with respect to the roadway surface. Housing 567 further includes lower front lip 569 which further supports a signal means 92. Housing 567 has a bottom surface 571 having an interlock means which in this embodiment comprises three laterally spaced apart cavities 572 shown in FIG. 15E in phantom lines, and being positioned, sized, and dimensioned to receive upwardly extending angular projections 566 in secure frictional engagement. When the first and second interlock means are in such frictional engagement, the interlock means can resist separation of the signal means assembly 570 from the base member 540 by applied shear forces while facilitating removal and installation of the signal means assembly on said base member. When it is desired to replace signal means 92, housing 567 with signal means 92 attached thereto is easily removed by inserting an appropriate tool in slots 545 in base member 540 and prying housing 567 off support means 563. A new housing 567 with signal means 92 attached thereto is then snapped into place on existing support means 563.

It will be appreciated that any of the mechanical interlock embodiments generally illustrated in FIGS. 5A–E, 6A–E, 7A–E, 8A–D, and 9A–D, can be adapted for use as interlock means between support means 563 and housing 567 in the embodiment of FIG. 15. It further will be appreciated that any of the various mechanical interlock means disclosed herein can be used with any of the base member embodiments disclosed in the various FIGS. 11–14.

Finally, it will be understood that in any of the foregoing embodiments the signal means can be supported in the signal means housing either by an adhesive or by any of the mechanical interlock means disclosed herein and equivalents thereof.

Sun Country Pavement Markers

The instant invention also finds great utility in markers for use in "sun country" areas. As noted, these markers do not need to withstand the impact of snowplow blades, and therefore do not require an iron casting base member. Sun country markers of the prior art generally include a signal means assembly mounted in a shell-like housing made of strong, impact-resistant plastic, or in extruded members, such as in U.S. Pat. No. 5,392,728. The housing is secured directly to the pavement with an appropriate adhesive.

One form of sun country marker embodying the controlled tire impact feature of the instant invention is illustrated in FIGS. 16–23. The sun country pavement marker 105 comprises a base member 110, a top member 130, and one or more signal means 192.

Figure 20:
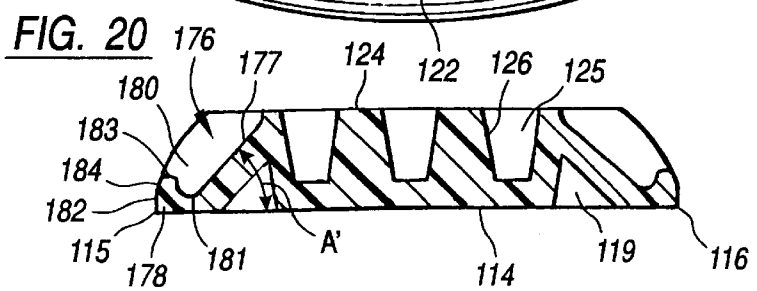
FIG. 20 is a side cross-sectional view of the base member taken along the lines 20—20 in FIG. 19.
Figure 18:
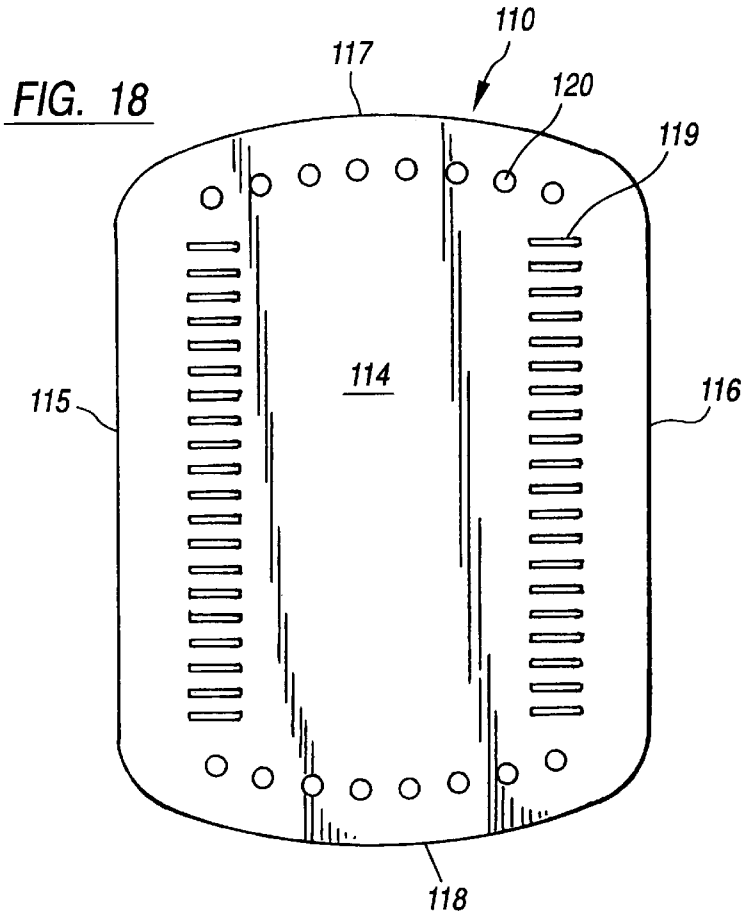
FIG. 18 is a bottom plan view of the base member of the pavement marker of FIG. 17.

As best shown in FIG. 18, base member 110 includes a flat bottom surface 114 having two substantially straight and parallel edges 115 and 116, transverse to the longitudinal direction of travel. Two curved edges 117 and 118 define the longitudinal edges, i.e., the edges parallel to the direction of travel. Parallel to each transverse edge 115 and 116 is at least one row of a plurality of recesses 119. The opening of each recess 119 is generally rectangular in shape. The internal shape of the recess is substantially triangular in cross section taken in the longitudinal direction (FIG. 20). Proximal to each longitudinal edge 117 and 118 is at least one row of a plurality of recesses 120. The opening of each recess 120 is circular in shape, and each recess 120 is generally cylindrical. When the bottom flat surface 114 is adhered to the roadway surface by means of a suitable adhesive, some of the adhesive will flow into the recesses 119 and 120, thus improving adhesion of the pavement marker 105 to the roadway surface.

Figure 19:
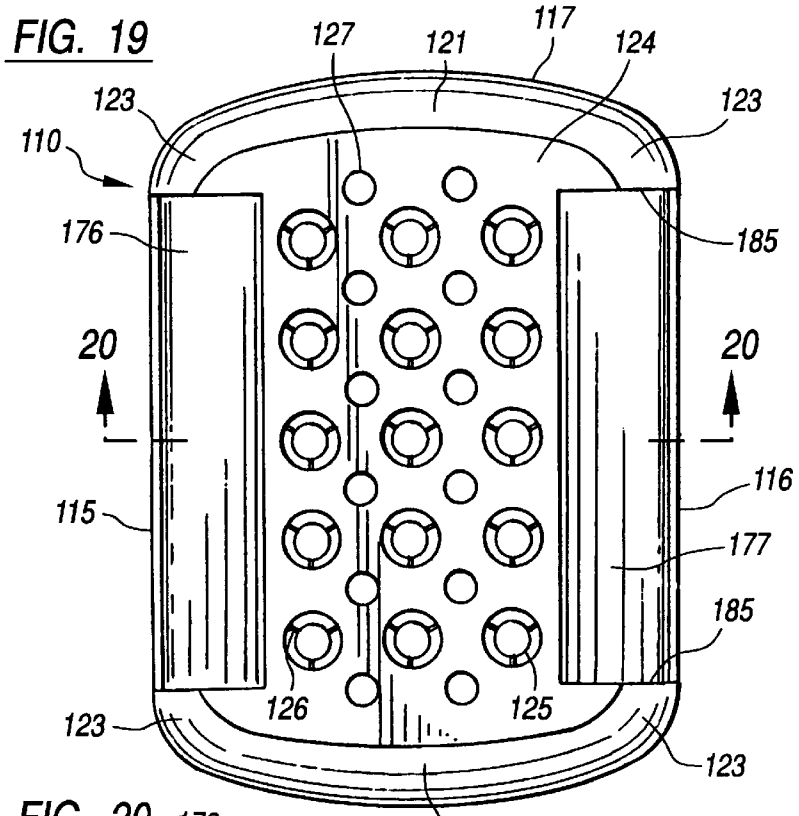
FIG. 19 is a top plan view of the base member of FIG. 18.

The top surface of each base member 110 is illustrated in FIG. 19. Rising from each bottom longitudinal edge 117, 118 are shoulders 121, 122, respectively. Each shoulder 121, 122 extends along the full length of its longitudinal edge and runs partly along each transverse edge 115, 116, to form rounded and inwardly inclined corners 123. Base member 110 has a flat top surface 124 substantially parallel to flat bottom surface 114. Flat top surface 124 includes a plurality of lug-receiving recesses 125, generally frusto-conical in shape with the narrow portion directed downward. The lug-receiving recesses 125 have on their inner surfaces a plurality, and typically three, downwardly directed ridges 126. Flat top surface 124 also includes a plurality of adhesive-receiving recesses 127, which recesses 127 are generally cylindrical.

Base member 110 further includes one and preferably two signal means pockets 176, generally parallel and proximal to transverse edges 115 and 116, respectively. Only one signal means pocket 176 will be described in detail, and it will be understood that the identical corresponding features will also be found in the optional oppositely facing signal means pocket 176. It further will be appreciated that signal means pocket 176 in sun country pavement marker 105 is similar in many respects to signal means pocket 76 in snowplowable pavement marker 30.

Each signal means pocket 176 includes an inclined support surface 177 integrally formed with upwardly extending lower lip 178. Inclined support surface 177 is disposed at an angle A with respect to the roadway surface; angle A will generally be in the range of about 30°–40°, but may be larger or smaller depending on the structure and recess depth of the marker design. Upwardly extending lower lip 178 comprises inner wall 180 which is substantially perpendicular to support surface 177 and with concave radiused conjunction 181 therebetween. Lower lip 178 further comprises substantially vertical front wall 182, which is integrally joined to upper wall 183 by convex radiused conjunction 184. Signal means pocket 176 is further defined by longitudinally extending side walls 185 which extend vertically from top flat surface 124 to bottom interior surface of lower lip 178 and horizontally from the forward-most edge of the corresponding shoulder 121, 122 to support surface 177.

Figure 16:
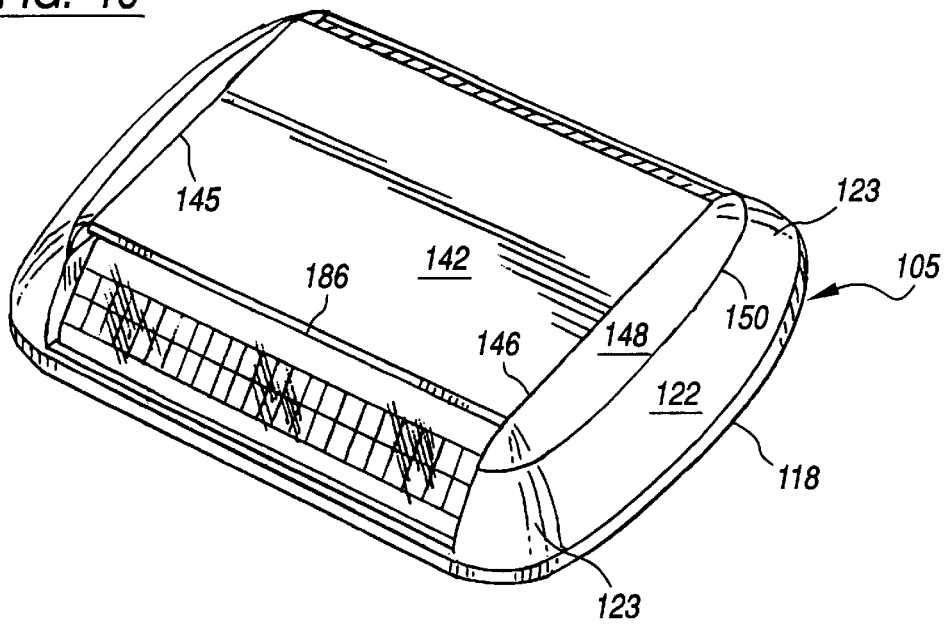
FIG. 16 is a perspective view of one embodiment of a sun country pavement marker of the instant invention, including a base member and a signal means, the marker embodying a protective tire-directing hood member of the instant invention for controlling the impact of oncoming vehicle tires on the signal means.
Figure 17:
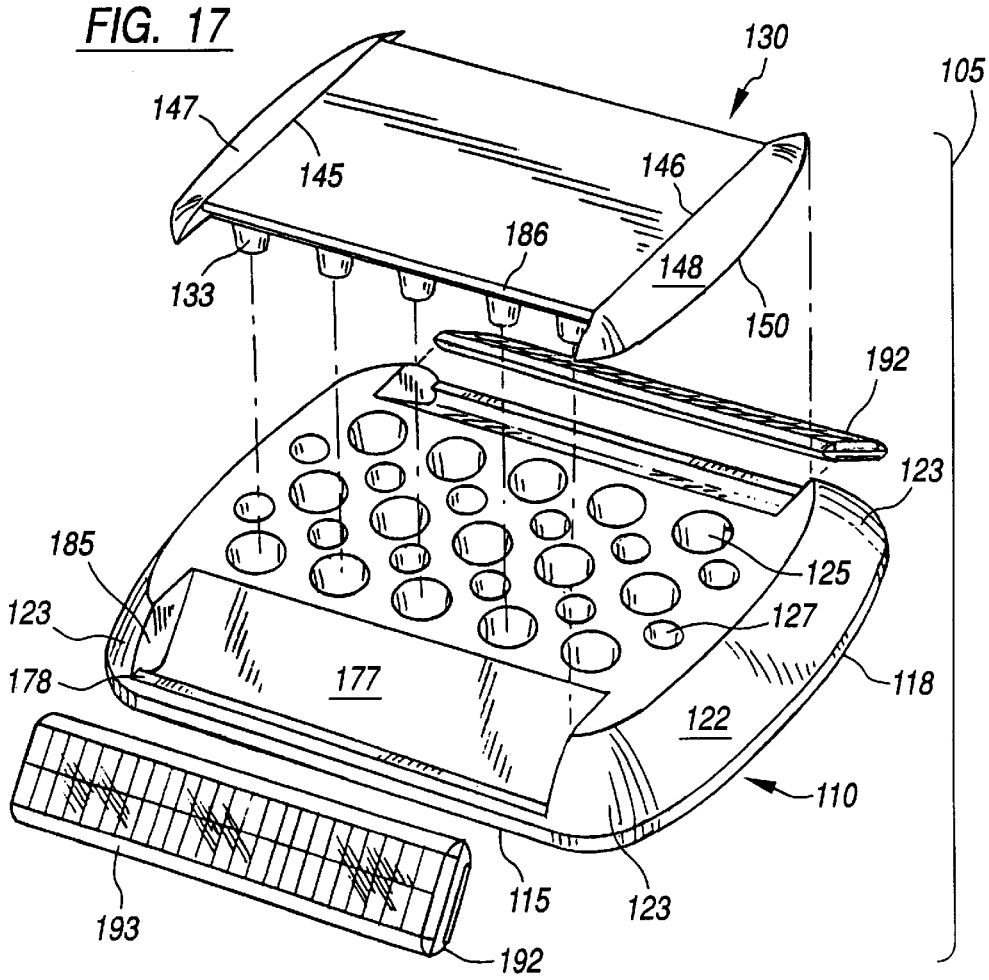
FIG. 17 is an exploded view of the sun country pavement marker of FIG. 16.
Figure 22:
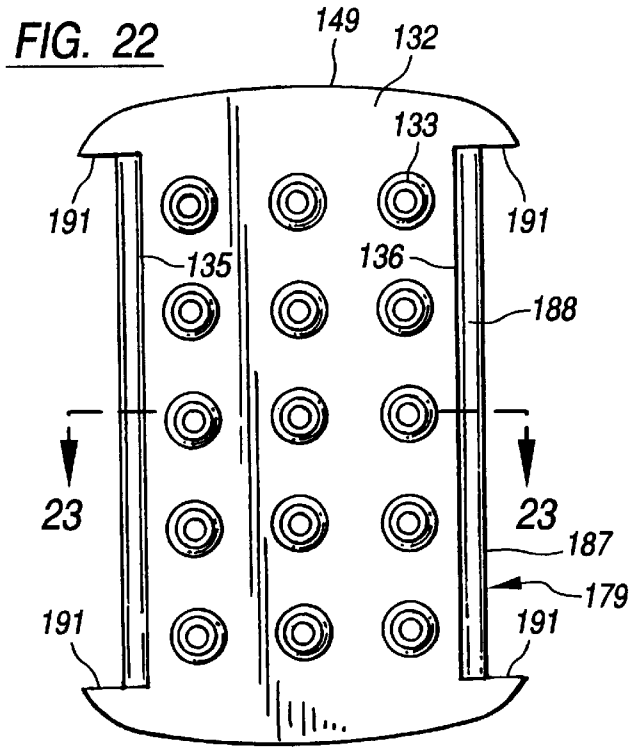
FIG. 22 is a bottom plan view of the top member of the pavement marker of FIG. 17.
Figure 23:
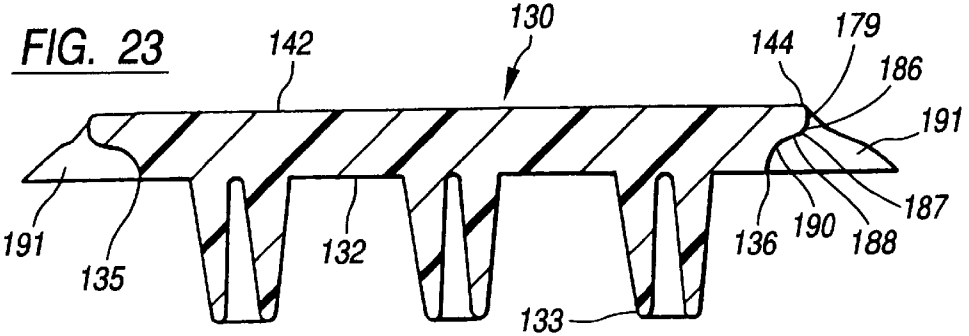
FIG. 23 is a cross-sectional view of the top member of the pavement marker of FIG. 17 taken along line 23—23 of FIG. 22.
Figure 21:
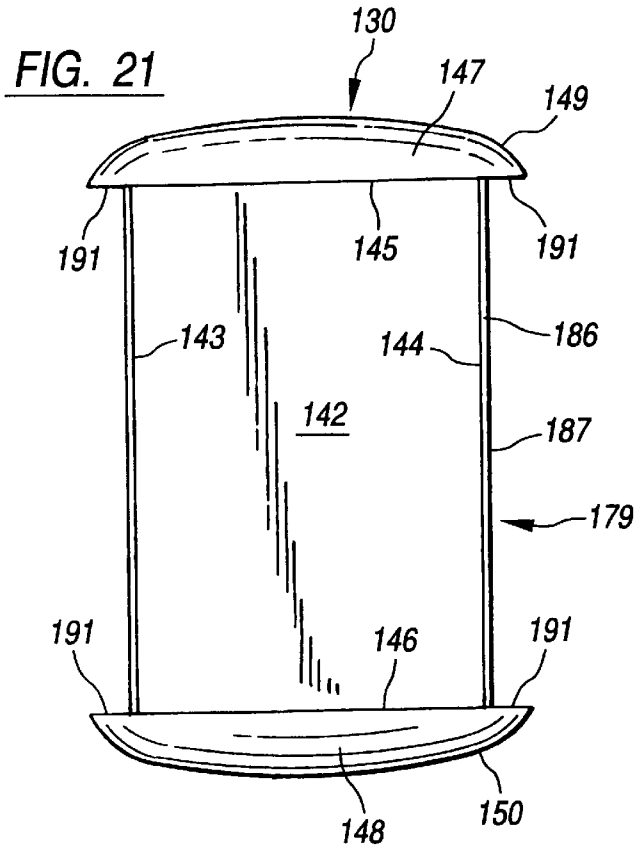
FIG. 21 is a top plan view of the top member of the pavement marker of FIG. 17.

Sun country pavement marker 105 further includes top member 130 illustrated in detail in FIGS. 21–23 and generally in FIGS. 16–17. Top member 130 includes bottom surface 132 of substantially the same size and shape as flat top surface 124 of base member 110. Bottom surface 132 is provided with a plurality of depending lugs 133 sized, shaped, and positioned to fit within the corresponding lug-receiving recesses 125 of base member 110. Each lug 133 is generally frusto-conical in shape and hollow. Bottom surface 132 has two transverse edges 135 and 136 which are also parallel to and run the width of signal means pockets 176.

Top member 130 includes top flat surface 142 substantially parallel to bottom flat surface 132. Top flat surface 142 is defined by transverse edges 143 and 144 and longitudinal edges 145 and 146. Shoulders 147, 148 extend downwardly from longitudinal edges 145, 146, respectively, and terminate at curved edges 149, 150. Edges 149, 150 mate with the upper edges of shoulders 121, 122 of base member 110, and the curvature of shoulders 147, 148 is continuous with that of shoulders 121, 122, such that when top member 130 is joined with base member 110, the resulting pavement marker 105 has uninterrupted curved longitudinal shoulders.

Top member 130 can be joined to base member 110 by known means such as adhesives, thermal joining, and welding.

Top member 130 further includes longitudinally extending protective hood member 179, which comprises front deflection surface 186 which is bounded by transverse edge 144 of top surface 142 and leading edge 187, and curved lower wall 188 extending between leading edge 187 and transverse edge 136.

Curved wall 188 has a convex portion 189 proximal to edge 187 and a concave portion 190 proximal to edge 136. Top member 130 further comprises longitudinal walls 191 which are bounded by curved wall 188, bottom surface 132 and shoulders 147, 148.

To assemble sun country marker 105, a signal means 192 (FIGS. 16, 17) is secured in the signal means pocket 176 by a suitable adhesive (or by ultrasonic welding or other suitable means, if appropriate to the materials used). Signal means 192 can be a retroreflector of the type known in the art for use in sun country markers, and typically includes a lens element containing a plurality of metallized retroreflective cube corner elements formed therein. A preferred lens element is illustrated in FIGS. 16–17. Signal means 192 rests on flat support surface 177, and is retained at its lower edge 193 by lower lip 178, and at its lateral edges by side walls 185. When so positioned in pocket 176, a part of the upper portion of signal means 192 extends above flat top surface 124 of base member 110. Top member 130 is then secured to base member 110 such as by means of a suitable adhesive or by welding, such that each lug 133 extending from bottom surface 132 of top member 130 is received by a corresponding lug-receiving recess 125 in base member 110. The top edge of signal means 192 is received within concave portion 190 of curved lower wall 188, and front deflection surface 186 extends longitudinally forward of the top edge of signal means 192. When so assembled, the recess depth of the marker front face, measured in the same manner as described above with respect to snowplowable markers, is in the range of about 0.10–0.13 in., and preferably about 0.12 inches.

When a tire from an oncoming vehicle passes over sun country marker 105, deflection surface 186 of protective hood member 179 will control the tire impact and direct the tire contact away from the upper portion of signal means 192, thereby reducing cracking and other damage that can occur when a tire runs over a pavement marker. At the same time, front deflection surface 186 cooperates with shoulders 147, 148 of top member 130, longitudinal walls 191, and rounded corners 123 of base member 110 to guide the tire toward the lower portion of signal means 192, to provide effective wiping thereof, thereby improving the overall reflectivity of the pavement marker.

Figure 24:
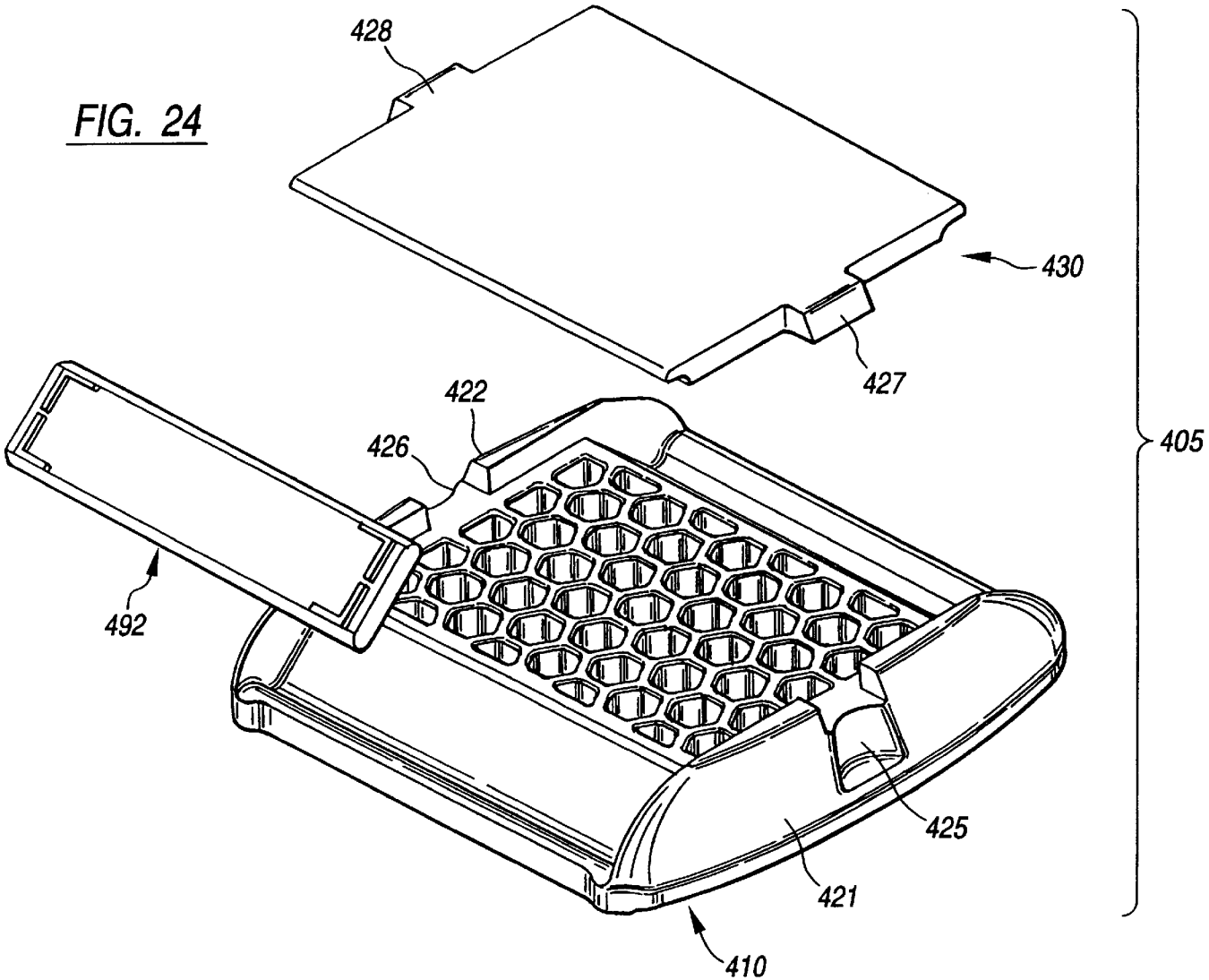
FIG. 24 illustrates an alternative embodiment of the sun country marker of FIGS. 16–23.

An alternative embodiment of a sun country marker of the instant invention is illustrated in FIG. 24. This marker 405 is substantially similar to marker 105 of FIGS. 16–23, having a base member 410, a top member 430, and signal means 492 (cube corner reflectors not shown). Base member 410 has longitudinal shoulders 421, 422, each of which is provided with a depression 425, 426. Top member 430 has two transversely projecting tabs 427, 428, sized and positioned on top member 430 to extend over depressions 425, 426 when the base member 410 and the top member 430 are assembled. Preferably, depressions 425, 426 are sized and shaped to accommodate a person's fingers, so that a person may place their fingers in depressions 425, 426 and lift upward under projections 427, 428 to easily hold pavement marker 405 to facilitate installation on a roadway surface.

Figure 25:
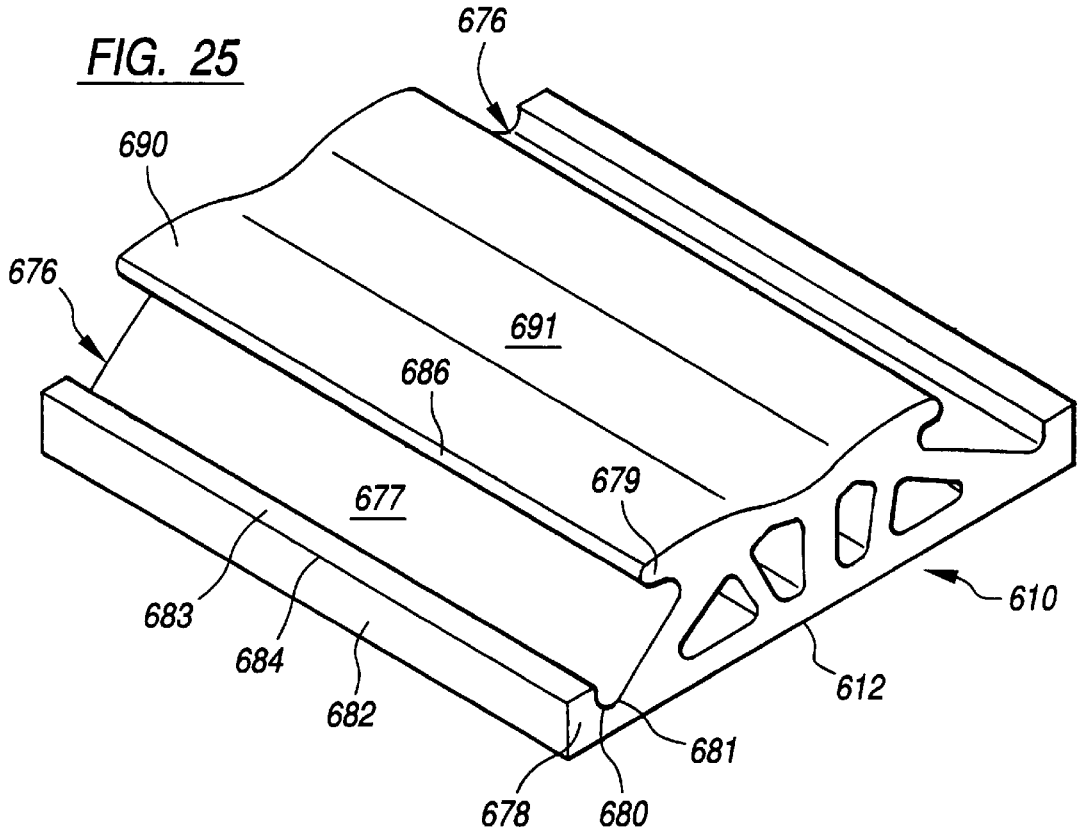
FIG. 25 is a perspective view of another embodiment of a pavement marker of the instant invention in which the base member may be extruded.
Figure 26:
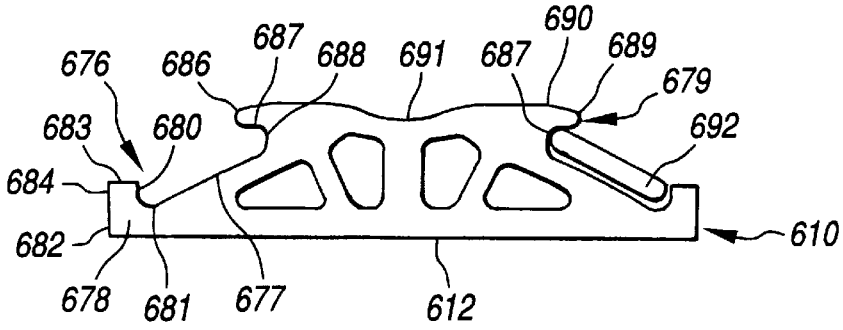
FIG. 26 is a side view of the embodiment of FIG. 25.
Figure 27:
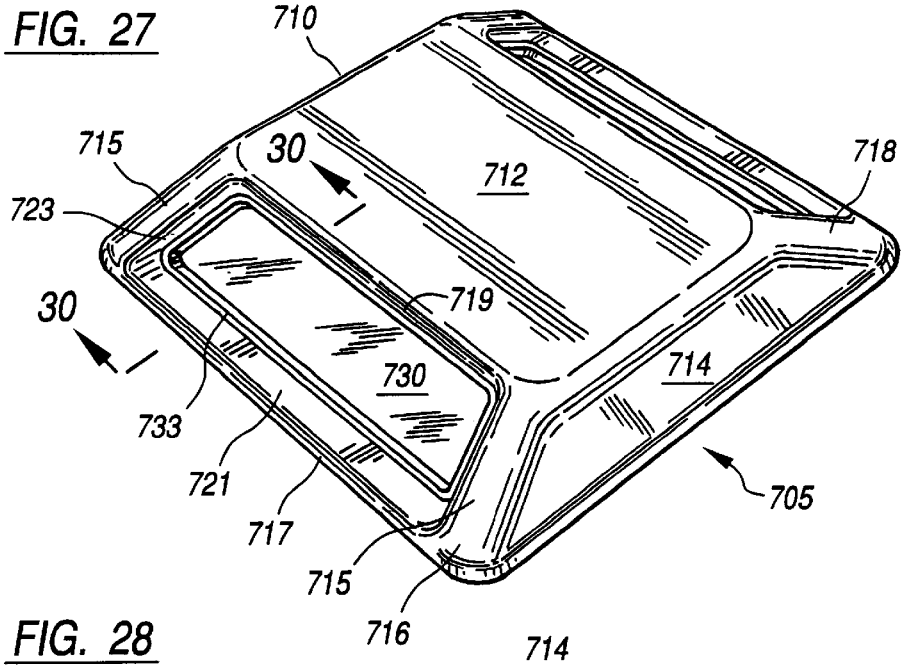
FIG. 27 is a perspective view of yet another alternative embodiment of a sun country pavement marker of the instant invention.

A pavement marker base member of the instant invention having a protective tire-directing hood member can also be made by extrusion, such as extruded aluminum or an extruded tough plastic such as high impact polystyrene or long glass fiber reinforced nylon. FIG. 25 is a perspective view of one embodiment of an extruded high impact polystyrene base member of the instant invention, and FIG. 26 is a side elevation view of the same base member with a signal means mounted in one of the signal means pockets.

As shown in FIG. 25, extruded base member 610 has a flat bottom surface 612 which is adhered to a roadway surface.

The bi-directional embodiment of FIG. 25 is provided with two oppositely-facing signal means pockets 676 for retaining signal means 692 therein. Each signal means pocket 676 is defined by a relatively flat support surface 677, an upwardly extending lower lip 678, and a longitudinally extending protective tire-directing hood member 679, the flat support surface 677 being integrally formed with lower lip 678 and protective hood member 679. Flat support surface 677 may be inclined to support the signal means 692 at an angle A" in the range of 30°–40°. Lower lip 678 comprises inner wall 680 joined to support surface 677 by concave radiused conjunction 681 therebetween. Lower lip 678 further comprises a substantially vertical front wall 682 which is joined to upper wall 683 at transverse edge 684.

Longitudinally extending protective tire-directing hood member 679 includes front tire-directing surface 686, integrally formed with upper wall 687 of pocket 676, which upper wall 687 is joined to support surface 677 at concave radiused conjunction 688. Base member 610 further includes top surface 690, with a concave region 691 along the transverse axis. Longitudinally protective tire-directing hood member 679 includes convex radiused conjunction 689 which joins top surface 690 and front tire-directing surface 686.

Each signal means pocket 676 will accommodate a signal means generally designated by the numeral 692, which will be understood to encompass the myriad types of signal means known in the art and discussed hereinabove. Further, the signal means 692 may be provided with a protective glass plate or other abrasion-resistant protective coating. Signal means 692 can be mounted in signal means pocket 676 by adhesive, or by any of the mechanical interlock means discussed above.

The contact between an oncoming vehicle tire and a signal means disposed in base member 610 will depend on factors such as the angle between the signal means front face and the pavement surface, and the recess depth of the signal means front surface, as previously defined herein.

Yet another embodiment of a sun country marker of the instant invention is illustrated in FIGS. 27–30. In this embodiment, pavement marker 705 comprises an injection molded hollow base member 710. Base member 710 comprises top wall 712 substantially parallel to the pavement surface, inwardly inclined longitudinal side walls 714, and front and rear inwardly inclined walls 716, 718. Each front and rear inclined wall 716, 718 includes an opening 720 therein for receiving a retroreflective lens. Opening 720 is defined by lower edge 722, upper edge 724, and side edges 726. Front wall 716 comprises two side portions 715, and bottom portion 717. Opening 720 is surrounded by a circumferential lip that connects the edges of opening 720 with the surrounding wall portions; specifically, lower lip portion 721 connects lower wall portion 717 and lower edge 722, side lip portions 723 connect side wall portions 715 and side edges 726, and upper lip portion 719 connects top wall 712 and upper edge 724. Upper lip portion 719 and the portion of the top wall 712 adjacent thereto together form a longitudinally extending tire directing hood portion. The walls of base member 710 and the various portions thereof are joined at radiused edges so there are no sharp edges or sharp corners.

Pavement marker 705 further includes lens member 730, which can be molded of a transparent plastic, as is known in the art. Lens member 730 has a front light receiving surface 732 and a rear surface 734 provided with a plurality of cube corner retroreflective elements; rear surface 734 can be metallized. Front surface 732 is provided along its inner periphery with forwardly extending rim 733, so sized and dimensioned as to fit just within the edges of opening 720. The front face 732 within rim 733 may be provided with a protective element 735, which can be, for example, either a layer of an abrasion-resistant polymer or a piece of untempered glass, which can be applied to front face 732 by known methods as described and referenced hereinabove.

Figure 28:
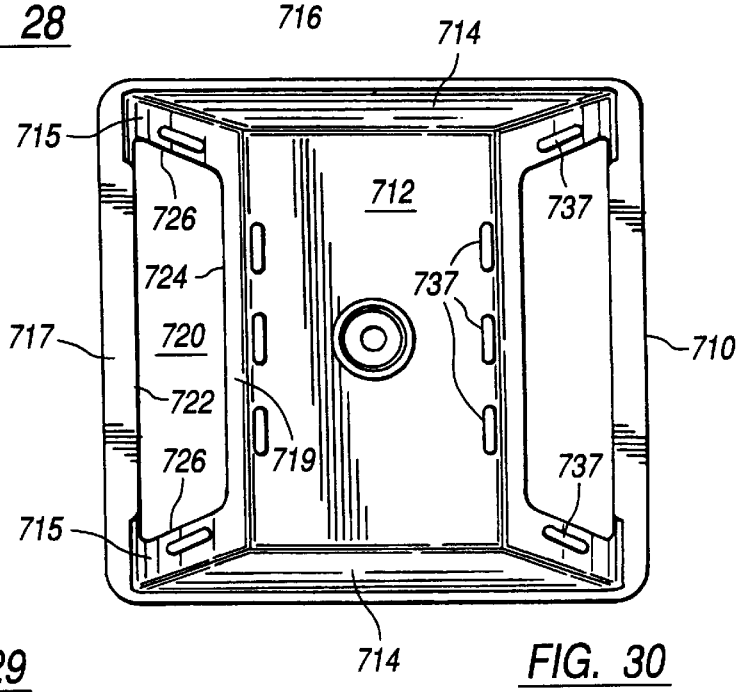
FIG. 28 is a bottom plan view of the base member of the pavement marker of FIG. 27.
Figure 29:
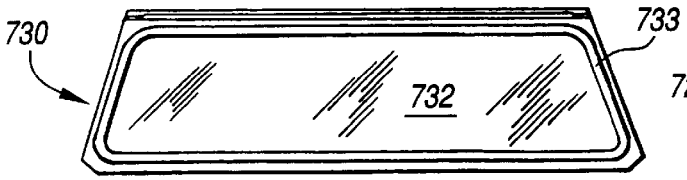
FIG. 29 is a front elevation view of the reflector face prior to installation in the base member of the pavement marker of FIG. 27.

Referring to FIG. 28, the underside of base member 710 includes a plurality of downwardly extending tabs 737 disposed around the periphery of opening 720. Lens member 730 is fitted to the underside of base member 710 such that the periphery of lens member 730 is in snap-fitting relationship with the plurality of downwardly extending tabs 737, and forwardly extending rim 733 snug against the periphery of opening 720. Once the lens members 730 are in place, the inside of base member 710 can be filled or "potted" such as with an epoxy compound, as is well known in the art.

Figure 30:
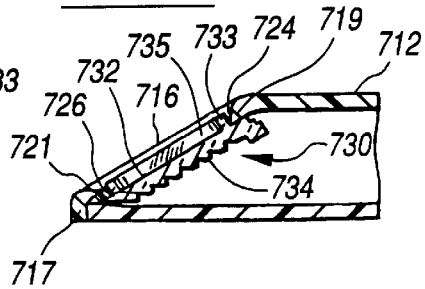
FIG. 30 is a side cross-section view along line 30—30 of FIG. 27.

In the embodiment illustrated, the lens front surface 732 is disposed at an angle A of 30° with respect to the pavement surface, and the recess depth as defined hereinabove is about 0.120 inches. As shown in FIG. 30, upper lip portion 719 defines a longitudinally extending tire directing hood member that extends over and protects the upper portion and upper generally corner portions of lens member 730, while still allowing tire wiping at the lower portion of the reflector.

The embodiment of FIGS. 27–30 should be fabricated from a material that can withstand repeated tire impacts without functional damage to the tire-directing hood member. Generally, such a material will have flexural modulus of about 75,000–350,000 psi at room temperature; tensile strength of about 1000–10,000 psi at room temperature; Shore hardness between about 40A and 60D at room temperature; and Gardner impact strength between about 75–200 in-lbs at −20° C. Certain urethane polymers meet these performance criteria, but they can be expensive, as well as difficult to mold. It has been found that good performance can be obtained with mixtures of thermoplastic elastomers (TPE's) with impact grade polypropylene. A particularly preferred blend is 70% Acetuf 3243 polypropylene with 30% M. A. Hanna SEBS XL1043-1 thermoplastic elastomer. UV stabilizers can be added to the blend, as is known in the art.

Yet another embodiment of a sun country marker of the instant invention can be understood with reference to FIGS. 1–4, wherein it may be seen that signal means assembly 70 can be used alone, without snowplowable base member 40, as an alternative embodiment of an extruded aluminum sun country pavement marker having a longitudinally extending tire-directing hood member of the instant invention. In this embodiment, bottom flat surface 74 of housing member 72 is simply secured directly to a roadway surface by means of a suitable adhesive.

Preliminary roadway tests of the various marker embodiments illustrated and described herein have demonstrated the unexpectedly high level of signal means protection afforded by sun country markers of the instant invention. Various embodiments of the sun country pavement marker of the instant invention have been evaluated and compared with prior art sun country markers in accordance with the National Transportation Product Evaluation Program (NTPEP). Ten types of markers were evaluated, as follows 1) a prior art marker by Minnesota Mining and Manufacturing, designated as 3M Model 290, having a lens angle A of 30°; 2) a prior art marker of the assignee herein designated as Model 88 having a lens angle A of 35°; 3) a prior art low profile glass-faced marker of the assignee herein designated as Model 948, having a lens angle A of 30°; 4) a prior art marker of the assignee herein being a longer-life version of the Model 948 and designated Model 953, in which the retroreflector comprises hexagonal cube corner elements, and having a lens angle A of 35°; 5) a prior art Model 953 with slightly delaminated glass face and having a lens angle A of 35°; 6) a marker of the instant invention generally as indicated in FIGS. 27–30, and having a lens angle A of 30° and a recess depth of about 0.120 inches. and being made of a polypropylene/elastomer blend as discussed above; 7) a marker of the instant invention generally indicated in FIGS. 16–23 and fabricated of high impact polystyrene, having a lens angle A of about 40° and a recess depth of about 0.075 inches; 8) a marker of the instant invention generally as indicated in FIGS. 16–23 and fabricated of long-fiber reinforced nylon, having a lens angle A of about 40° and a recess depth of about 0.075 inches; 9) a marker of the instant invention generally indicated at FIG. 25 and extruded of glass-filled acrylic-butadiene-styrene polymer and "potted," having a lens angle A of 30° and a recess depth of 0.080 inches; 10) an aluminum extrusion of the type designated as housing 72 for signal means assembly 70 in FIGS. 1–4, but used without a snowplowable base member, the member having a lens angle A of 35° and a recess depth of about 0.10 inches. Samples of each of the ten types of markers were installed in three separate groups: 1) a "focus" group, installed on concrete just outside an on-ramp from a weigh station, and therefore subject to truck crossover traffic; 2) a "concrete" group installed on concrete in an area that does not receive more than usual crossover traffic; and 3) an "asphalt" group installed on asphalt in an area that does not receive more than usual crossover traffic. All samples were adhered to the roadway with bitumin adhesive, as is known in the art.

After one month, the glass faces were intact on all the pavement markers of the instant invention, i.e., markers of type 6–10 in the list above. No evidence of cracking, chipping, or breaking was present. Prior art markers of groups 1 and 4 above showed "peening" at the top edge of the reflector front face; such damage was not apparent in any of the inventive type 6–10 markers.

After three months, the markers of prior art types 3 and 4 showed continued chipping of the glass face; this chipping damage was also beginning to occur in the inventive 3-piece markers of types 7 and 8 and the plastic extrusion of type 9. No such damage was observed, however, in the inventive markers of types 6 and 10, both of which have a more pronounced longitudinally extending tire-directing hood. Moreover, the type 6 and type 10 markers did not exhibit any excessive accumulation of dirt, indicating that the lens members were experiencing adequate tire wiping action. Furthermore, despite the slight chipping of the glass face in the inventive 3-piece markers, the lenses did not crack. Significantly, some of these 3-piece markers exhibited longitudinally extending hoods that had deformed slightly from impact, yet still protected the lens from cracking.

The markers were inspected again at six months of performance. The prior art marker of type 1 generally held up well structurally, although two of the units appeared susceptible to breakage. The prior art markers of types 4 and 5 also showed some structural damage. The inventive markers of type 6 showed more structural damage such as tearing and shearing. Yet despite the damage, these markers retained about 89% of their retroreflectivity, measured as specific intensity, between the three-month and six-month inspections. The inventive markers of types 7 and 8 showed that the added protection of the hood member continued to have a positive effect on reflectivity. The long glass fiber-reinforced nylon markers were more durable than the high impact polystyrene markers, and both materials exhibited excellent retention to the road. The plastic extrusion marker of inventive type 9 exhibited limited reflector retention and limited road adhesion. In the aluminum extruded pavement markers of inventive type 10, the protective hood member continued to provide excellent protection to the reflectors. The reflectors had no damage, and the glass faces over the lenses were in "as-new" condition. A few of the aluminum markers had marks as evidence of tire impact, but did not sustain serious damage. These markers also had excellent retention to the road.

In both snow country markers and sun country markers, the length of the extension of the longitudinally extending protective hood member over the top edge of the signal means will be selected by the pavement marker designer for the particular characteristics of the marker required for the particular application. For example, in sun country uses it may be desirable for the protective hood member to extend out sufficiently far such that only a small surface of the signal means is contacted by the tire. other applications may require more wiping of the signal means by the tire. As noted, dimensions of a hood member found to be particularly effective are 0.100–0.120 inches. The selection of a hood dimension may depend on the angle of the lens with respect to the pavement surface.

What is claimed is:

1. A pavement marker for establishing on a finished roadway surface a marking visible from an oncoming vehicle, said pavement marker comprising:

a base member adapted to be mounted on the associated roadway surface;

a signal means for providing a signal to a driver in an oncoming vehicle, said signal means comprising a front face disposed at a predetermined angle with respect to the roadway surface, said front face having an upper edge, lateral edges which intersect said upper edge at upper generally corner portions, an upper portion below said upper edge, and a lower portion below said upper portion;

a support means for supporting said signal means on said base member such that an oncoming vehicle tire can contact at least a portion of said signal means front face in use; and a protective tire-directing hood member for controlling the impact of the vehicle tire on said pavement marker, said hood member being disposed above said upper edge of said signal means front face, and extending longitudinally over said upper portion and generally corner portions of said signal means front face, said protective tire-directing hood member cooperating with said base member to direct tire contact away from said upper edge, upper generally corner portions, and upper portion of said signal means front face, while allowing some tire contact at said lower portion of said signal means front face;

wherein said marker can accommodate the movement thereover of a snowplow blade and wherein said hood member is unitary with said base member.

2. The pavement marker of claim 1 wherein said support means is unitary with said base member.

3. The pavement marker of claim 2 wherein said signal means is mounted to said support means by means of an adhesive.

4. The pavement marker of claim 1 further comprising a first interlock means on said signal means, and a second interlock means on said support means, said first and second interlock means cooperating to provide an interlock fit between said signal means and said support means, and to facilitate planned removal of said signal means from said pavement marker.

5. The pavement marker of claim 1 wherein said support means is not unitary with said base member.

6. The pavement marker of claim 5 wherein said base member comprises a means for receiving said support means, and said support means is structured to be received in said receiving means.

7. The pavement marker of claim 6 wherein said receiving means is an opening in said base member.

8. The pavement marker of claim 4 wherein said first interlock means comprises a first plurality of projecting structures and said second interlock means comprises a second plurality of projecting structures, said first and second pluralities of projecting structures being engageable with each other to resist separation of said signal means from said support means by applied shear forces.

9. The pavement marker of claim 8 wherein one of said pluralities of projecting structures is a plurality of hook elements and the other of said pluralities of projecting structures is a plurality of loop elements, said hook and loop elements being engageable with each other.

10. The pavement marker of claim 4 wherein one of said interlock means comprises at least one projecting member and the other of said interlock means comprises at least one recess, said at least one projecting member fitting into said at least one recess by frictional engagement to resist separation of said signal means from said support means by applied shear forces.

11. A pavement marker for establishing on a finished roadway surface a marking visible from an oncoming vehicle, said pavement marker comprising:

a base member adapted to be mounted on the associated roadway surface;

a signal means for providing a signal to a drive in an oncoming vehicle, said signal means comprising a front face disposed at a predetermined angle with respect to the roadway surface, said front face having an upper edge, lateral edges which intersect said upper edge at upper generally corner portions, and upper portion below said upper edge, and a lower portion below said upper portion;

a support means for supporting said signal means on said base member such that an oncoming vehicle tire can contact at least a portion of said signal means front face in use; and a protective tire-directing hood member for controlling the impact of the vehicle tire on said pavement marker, said hood member being disposed above said upper edge of said signal means front face, and extending longitudinally over said upper portion and generally corner portions of said signal means front face, said protective tire-directing hood member cooperating with said base member to direct tire contact away from said upper edge, upper generally corner portions, and upper portion of said signal means front face, while allowing some tire contact at said lower portion of said signal means front face;

wherein said marker can accommodate the movement thereover of a snowplow blade;

further comprising a signal means assembly removably mountable on said base member, said signal means assembly comprising said signal means and said impact controlling means.

12. The pavement marker of claim 11 further comprising a first interlock means on said signal means assembly a second interlock means on said base member, said first and second interlock means cooperating to provide an interlock fit between said signal means assembly and said base member, to resist separation of said signal means assembly from said base member by applied shear forces while facilitating removal and installation of said signal means assembly from and on said base member.

13. The pavement marker of claim 12 wherein one of said interlock means comprises at least one projecting member and the other of said interlock means comprises at least one recess, said at least one projecting member fitting into said at least one recess by frictional engagement to resist separation of said signal means assembly from said base member by applied shear forces.

14. The pavement marker of claim 12 wherein said first interlock means comprises a first plurality of projecting structures and said second interlock means comprises a second plurality of projecting structures, said first and second pluralities of projecting structures being engageable with each other to resist separation of said signal means assembly from said base member by applied shear forces.

15. The pavement marker of claim 14 wherein one of said pluralities of projecting structures is a plurality of hook elements and the other of said pluralities of projecting structures is a plurality of loop elements, said hook and loop elements being engageable with each other.

16. The pavement marker of claim 12 wherein said second interlock means is unitary with said base member.

17. The pavement marker of claim 12 wherein said base member comprises an insert member and a means for receiving said insert member, and wherein said insert member comprises said support means and second interlock means.

18. The pavement marker of claim 11 wherein said insert member is retained at said receiving means by means of an adhesive.

19. The pavement marker of claim 17 wherein said insert member is retained at said receiving means by means of frictional engagement.

20. The pavement marker of claim 11 wherein said signal means assembly is mounted on said base member by means of an adhesive.

21. The pavement marker of claim 11 wherein said signal means assembly is mounted to said base member by means of a tool inserted through said signal means assembly and said base member.

22. A pavement marker for establishing on a finished roadway surface a marking visible from an oncoming vehicle, said pavement marker comprising:

a base member adapted to be mounted on the associated roadway surface;

a signal means for providing a signal to a driver in an oncoming vehicle, said signal means comprising a front face disposed at a predetermined angle with respect to the roadway surface, said front face having an upper edge, lateral edges which intersect said upper edge at upper generally corner portions, an upper portion below said upper edge, and a lower portion below said upper portion;

a support means for supporting said signal means on said base member such that an oncoming vehicle tire can contact at least a portion of said signal means front face in use; and a protective tire-directing hood member for controlling the impact of the vehicle tire on said pavement marker, said hood member being disposed above said upper edge of said signal means front face, and extending longitudinally over said upper portion and generally corner portions of said signal means front face, said protective tire-directing hood member cooperating with said base member to direct tire contact away from said upper edge, upper generally corner portions, and upper portion of said signal means front face, while allowing some tire contact at said lower portion of said signal means front face;

wherein said base member is formed of an extruded material.

23. The pavement marker of claim 22 wherein said base member further comprises a substantially flat bottom surface adapted for adhesion to the associated roadway surface.

24. The pavement marker of claim 23 wherein said support means and said signal means are structured and arranged such that said signal means front face in use is at an angle of about 25°–45° with respect to the associated roadway surface.

25. A pavement marker for establishing on a finished roadway surface a marking visible from an oncoming vehicle said pavement marker comprising:

a base member adapted to be mounted on the associated roadway surface;

a signal means for providing a signal to a driver in an oncoming vehicle, said signal means comprising a front face disposed at a predetermined angle with respect to the roadway surface, said front face having an upper edge, lateral edges which intersect said upper edge at upper generally corner portions an upper portion below said upper edge, and a lower portion below said upper portion;

a support means for supporting said signal means on said base member such that an oncoming vehicle tire can contact at least a portion of said signal means front face in use; and a protective tire-directing hood member for controlling the impact of the vehicle tire on said pavement marker, said hood member being disposed above said upper edge of said signal means front face, and extending longitudinally over said upper portion and generally corner portions of said signal means front face, said protective tire-directing hood member cooperating with said base member to direct tire contact away from said upper edge, upper generally corner portions, and upper portion of said signal means front face, while allowing some tire contact at said lower portion of said signal means front face;

wherein said marker can accommodate the movement thereover of a snowplow blade and wherein said base member is formed of cast metal.

26. The pavement marker of claim 21 wherein said signal means comprises a lens member of light-transmitting synthetic resin having a front face and a rear face, said rear face having retroreflective means on at least a portion thereof for reflecting light transmitted through said front face back to the source thereof.

27. The pavement marker of claim 26, wherein said retroreflective means comprises a plurality of cube-corner type retroreflector elements.

28. The pavement marker of claim 27 wherein the rear surfaces of said retroreflective cube-corner type reflector elements are metallized.

29. The pavement marker of claim 27 wherein cube corner elements are microcubes.

30. The pavement marker of claim 27 wherein said rear surface of said signal means includes a plurality of rearwardly extending walls, said walls cooperating with said support member to define hermetically sealed cells, one or more of said retroreflector cube-corner type reflector elements being disposed in each said cell.

31. The pavement marker of claim 26 wherein said retroreflective means comprises glass beads.

32. The pavement marker of claim 26 wherein said retroreflective means comprises plastic beads.

33. The pavement marker of claim 26 wherein said retroreflective means comprises ceramic beads.

34. The pavement marker of claim 25 wherein said signal means comprises a retroreflective sheet material.

35. The pavement marker of claim 34 wherein said retroreflective sheet material comprises retroreflective microcube corner elements.

36. The pavement marker of claim 34 wherein said retroreflective sheet material comprises retroreflective glass beads.

37. The pavement marker of claim 34 wherein said retroreflective sheet material comprises retroreflective cube corner elements and retroreflective glass beads.

38. The pavement marker of claim 25 wherein said signal means front face is provided with an abrasion-resistant overlay, said overlay reducing the degradation of optical efficiency normally caused by abrasive tire contract on said signal means.

39. The pavement marker of claim 38 wherein said overlay is glass.

40. The pavement marker of claim 38 wherein said overlay is a polymeric coating.

41. The pavement marker of claim 38 wherein said overlay is a self-healing coating.

42. The pavement marker of claim 25 wherein said marker is for use in snow areas and wherein said base member protects said signal means from damage by oncoming snowplow blades which are disposed at an angle to the direction of travel thereof during snowplowing operations.

43. The pavement marker of claim 42 wherein said base member is adapted to be disposed in a complementary recess in the associated roadway surface, said base member further comprising two laterally spaced-apart inclined surfaces, each extending longitudinally of said base member from adjacent to one end thereof upwardly toward an uppermost portion of said base member, said support means being disposed between said inclined surfaces such that said signal means is carried by said support means and is disposed between and below said inclined surfaces so that an oncoming angled snowplow blade will ride up said inclined surfaces and be deflected from contact with said signal means as the snowplow blade passes over said pavement marker, said signal means and base member being adapted to allow some contact of said signal means front face lower portion by the tires of oncoming vehicles.

44. The pavement marker of claim 43, wherein said tire-directing protective hood member extends between the uppermost ends of said inclined surfaces, said protective hood member cooperating with said inclined surfaces to further facilitate deflection of an oncoming angled snowplow blade from contact with said signal means front face, and to direct tire contact away from said upper edge, upper portion, and upper generally corner portions of said signal means front face, while allowing some tire contact at said lower portion of said signal means front face.

45. The pavement marker of claim 44 wherein said support means and said signal means are structured and arranged so that said signal means front face in use is disposed at an angle of about 30° with respect to the roadway surface and the recess depth is at least about 0.15 inches.

46. The pavement marker of claim 44, wherein said support means and said signal means are structured and arranged such that said signal means front face is at an angle of about 40° with respect to the roadway surface and the recess depth is between about 0.09–0.14 inches.

47. The pavement marker of claim 43 wherein said base member further comprises channel means to facilitate drainage of fluid on said base member and in front of said front surface of said signal means.

48. The pavement marker of claim 47 wherein said channel means are structured and arranged so that the drainage of fluid through said channel means is facilitated by oncoming vehicle tires contacting said pavement marker.

49. The pavement marker of claim 48, wherein said drainage channels extend through said inclined surfaces.

50. The pavement marker of claim 42 wherein said pavement marker is snowplowable in one longitudinal direction.

51. The pavement marker of claim 42 wherein said pavement marker is snowplowable in two opposing longitudinal directions.

52. The pavement marker of claim 43 wherein said base member further comprises a third inclined surface disposed between said two laterally spaced-apart inclined surfaces, said third inclined surface extending longitudinally of said base member upwardly toward and in front of the front face of said signal means, to further facilitate an oncoming angled snowplow blade riding up said inclined surfaces and being deflected from contact with said signal means.

53. A pavement marker for establishing on a finished roadway surface a marking visible from an oncoming vehicle, said pavement marker comprising:

a base member adapted to be mounted on the associated roadway surface;

a signal means for providing a signal to a driver in an oncoming vehicle, said signal means comprising a front face disposed at a predetermined angle with respect to the roadway surface, said front face having an upper edge, lateral edges which intersect said upper edge at upper generally corner portions, an upper portion below said upper edge, and a lower portion below said upper portion;

a support means for supporting said signal means on said base member such that an oncoming vehicle tire can contact at least a portion of said signal means front face in use; and a protective tire-directing hood member for controlling the impact of the vehicle tire on said pavement marker, said hood member being disposed above said upper edge of said signal means front face, and extending longitudinally over said upper portion and generally corner portions of said signal means front face, said protective tire-directing hood member cooperating with said base member to direct tire contact away from said upper edge, upper generally corner portions, and upper portion of said signal means front face, while allowing some tire contact at said lower portion of said signal means front face;

wherein said base member comprises a one-piece injection molded shell.

54. The pavement marker of claim 53, wherein said base member comprises:

a bottom portion adapted to be adhered to a roadway surface, the bottom portion having a top surface, a support means for carrying said signal means and extending downwardly from said top surface, and shoulder means disposed on either side of said support means and adapted to be disposed about both sides of said signal means; and a top portion adapted to be fixed to said top surface of said bottom portion, said top portion including said means for controlling the impact of vehicle tires on said pavement marker.

55. The pavement marker of claim 54, wherein said means for controlling the impact of vehicle tires on said pavement marker comprises a protective tire-directing hood member that in use extends longitudinally over said upper portion and upper generally corner portions of said signal means front face, and deflection surfaces on either side of said protective tire-directing hood member, said protective tire-directing hood member and deflection surfaces on said top portion cooperating with said shoulder means on said bottom portion to direct the tire contact away from said upper edge, upper portion, and upper generally corner portions of said signal means front face, while allowing some tire contact at said lower portion of said signal means front face.

* * * * *